US008529212B2

(12) United States Patent
Smith et al.

(10) Patent No.: US 8,529,212 B2
(45) Date of Patent: Sep. 10, 2013

(54) MULTI-PART MODULAR AIRFOIL SECTION AND METHOD OF ATTACHMENT BETWEEN PARTS

(75) Inventors: J. Carey Smith, Lexington, KY (US); Richard W. Fizer, Lexington, KY (US); Richard M. Aynsley, Doonan (AU); Richard A. Oleson, Lexington, KY (US)

(73) Assignee: Delta T Corporation, Lexington, KY (US)

( * ) Notice: Subject to any disclaimer, the term of this patent is extended or adjusted under 35 U.S.C. 154(b) by 884 days.

(21) Appl. No.: 12/607,161

(22) Filed: Oct. 28, 2009

(65) Prior Publication Data

US 2010/0104461 A1 Apr. 29, 2010

Related U.S. Application Data

(60) Provisional application No. 61/109,220, filed on Oct. 29, 2008.

(51) Int. Cl.
*F03B 3/12* (2006.01)

(52) U.S. Cl.
USPC ..... 416/226

(58) Field of Classification Search
USPC ..... 416/226, 228, 229 R, 224, 62; 415/912
See application file for complete search history.

(56) References Cited

U.S. PATENT DOCUMENTS

| | | | | |
|---|---|---|---|---|
| 4,275,993 | A | 6/1981 | Sprengling | |
| 4,295,790 | A * | 10/1981 | Eggert, Jr. | 416/226 |
| 6,183,201 | B1 * | 2/2001 | Maby | 416/170 R |
| 6,237,873 | B1 | 5/2001 | Amakoa et al. | |
| 6,244,821 | B1 | 6/2001 | Boyd et al. | |
| 6,790,004 | B2 * | 9/2004 | Steinheiser | 416/65 |
| 6,939,108 | B2 | 9/2005 | Boyd | |
| 7,182,293 | B2 | 2/2007 | Sarh | |
| 7,252,478 | B2 | 8/2007 | Aynsley | |
| 7,284,960 | B2 * | 10/2007 | Aynsley | 416/223 R |
| 7,399,159 | B2 | 7/2008 | Matheny et al. | |
| D587,799 | S | 3/2009 | Oleson | |
| 2007/0140859 | A1 * | 6/2007 | Schreiber et al. | 416/223 R |

(Continued)

FOREIGN PATENT DOCUMENTS

WO WO 2009/100052 8/2009

OTHER PUBLICATIONS

U.S. Appl. No. 61/175,210, filed May 4, 2009, Oleson et al.
U.S. Appl. No. 61/248,158, filed Oct. 2, 2009, Aynsley et al.

(Continued)

*Primary Examiner* — Nathaniel Wiehe
*Assistant Examiner* — Adam W Brown
(74) *Attorney, Agent, or Firm* — King & Schickli, PLLC

(57) ABSTRACT

A fan system includes a motor, a rotatable hub, and a plurality of fan blades. Each of the fan blades includes a substantially rigid spine member, a resilient leading edge member, and a resilient trailing edge member. The leading edge member and trailing edge members are removably coupled with the spine member, such that different leading edge members and different trailing edge members may be chosen to customize the leading and trailing edges of the fan blades. Each fan blade may have more than one type of leading edge member or more than one type of trailing edge member. The leading edge member and trailing edge member may each be coupled with the spine member by urging the leading edge member and trailing edge member in a direction that is substantially perpendicular to the longitudinal axis defined by the spine member.

21 Claims, 12 Drawing Sheets

(56) References Cited

U.S. PATENT DOCUMENTS

| | | | |
|---|---|---|---|
| 2008/0008596 | A1 | 1/2008 | Aynsley |
| 2008/0014090 | A1 | 1/2008 | Aynsley et al. |
| 2008/0213097 | A1 | 9/2008 | Oleson et al. |
| 2009/0072108 | A1 | 3/2009 | Oleson |
| 2009/0081045 | A1 | 3/2009 | Scherer et al. |
| 2009/0097975 | A1 | 4/2009 | Aynsley et al. |
| 2009/0162197 | A1 | 6/2009 | Klemo et al. |
| 2009/0208333 | A1 | 8/2009 | Smith et al. |

OTHER PUBLICATIONS

International Search Report dated Feb. 3, 2010 for Application No. PCT/US2009/062326.

Written Opinion dated May 4, 2011 for Application No. PCT/US2009/062326.

* cited by examiner

MULTI-PART MODULAR AIRFOIL SECTION AND METHOD OF ATTACHMENT BETWEEN PARTS

PRIORITY

This application claims priority to U.S. Provisional Patent Application Ser. No. 61/109,220, entitled "Multi-Part Modular Airfoil Section and Method of Attachment Between Parts," filed Oct. 29, 2008, the disclosure of which is incorporated by reference herein.

BACKGROUND

A variety of fan systems have been made and used over the years in a variety of contexts. For instance, various ceiling fans are disclosed in U.S. Pat. No. 7,284,960, entitled "Fan Blades," issued Oct. 23, 2007; U.S. Pat. No. 6,244,821, entitled "Low Speed Cooling Fan," issued Jun. 12, 2001; and U.S. Pat. No. 6,939,108, entitled "Cooling Fan with Reinforced Blade," issued Sep. 6, 2005. The disclosures of each of those U.S. patents are incorporated by reference herein. Additional exemplary fans are disclosed in U.S. Pub. No. 2008/0008596, entitled "Fan Blades," published Jan. 10, 2008; U.S. Pub. No. 2009/0208333, entitled "Ceiling Fan System with Brushless Motor," published Aug. 20, 2009; and U.S. Provisional Patent App. No. 61/175,210, entitled "Ceiling Fan with Variable Blade Pitch and Variable Speed Control," filed May 4, 2009, the disclosures of which are also incorporated by reference herein. Alternatively, any other suitable fans may be used in conjunction with embodiments described herein.

A fan blade or airfoil may include one or more upper air fences and/or one or more lower air fences at any suitable position(s) along the length of the fan blade or airfoil. Merely exemplary air fences are described in U.S. Provisional Patent App. No. 61/248,158, entitled "Air Fence for Fan Blade," filed Oct. 2, 2009, the disclosure of which is incorporated by reference herein. Alternatively, any other suitable type of component or feature may be positioned along the length of a fan blade or airfoil; or such components or features may simply be omitted.

The outer tip of a fan blade or airfoil may be finished by the addition of an aerodynamic tip or winglet. Merely exemplary winglets are described in U.S. Pat. No. 7,252,478, entitled "Fan Blade Modifications," issued Aug. 7, 2007, the disclosure of which is incorporated by reference herein. Additional winglets are described in U.S. Pub. No. 2008/0014090, entitled "Cuffed Fan Blade Modifications," published Jan. 17, 2008, filed Sep. 25, 2007, the disclosure of which is incorporated by reference herein. Still other exemplary winglets are described in U.S. Design Pat. No. D587,799, entitled "Winglet for a Fan Blade," issued Mar. 3, 2009, the disclosure of which is incorporated by reference herein. In some settings, such winglets may interrupt the outward flow of air at the tip of a fan blade, redirecting the flow to cause the air to pass over the fan blade in a perpendicular direction, and also ensuring that the entire air stream exits over the trailing edge of the fan blade and reducing tip vortex formation. In some settings, this may result in increased efficiency in operation in the region of the tip of the fan blade. In other variations, an angled extension may be added to a fan blade or airfoil, such as the angled airfoil extensions described in U.S. Pub. No. 2008/0213097, entitled "Angled Airfoil Extension for Fan Blade," published Sep. 4, 2008, the disclosure of which is incorporated by reference herein. Other suitable structures that may be associated with an outer tip of an airfoil or fan blade will be apparent to those of ordinary skill in the art.

Alternatively, the outer tip of an airfoil or fan blade may be simply closed (e.g., with a cap or otherwise, etc.), or may lack any similar structure at all.

The interface of a fan blade and a fan hub may also be provided in a variety of ways. For instance, an interface component is described in U.S. Pub. No. 2009/0081045, entitled "Aerodynamic Interface Component for Fan Blade," published Mar. 26, 2009, the disclosure of which is incorporated by reference herein. Alternatively, the interface of a fan blade and a fan hub may include any other component or components, or may lack any similar structure at all.

Fans may also include a variety of mounting structures. For instance, a fan mounting structure is disclosed in U.S. Pub. No. 2009/0072108, entitled "Ceiling Fan with Angled Mounting," published Mar. 19, 2009, the disclosure of which is incorporated herein. In addition, a fan may include sensors or other features that are used to control, at least in part, operation of a fan system. For instance, such fan systems are disclosed in U.S. Pub. No. 2009/0097975, entitled "Ceiling Fan with Concentric Stationary Tube and Power-Down Features," published Apr. 16, 2009, the disclosure of which is incorporated by reference herein; U.S. Pub. No. 2009/0162197, entitled "Automatic Control System and Method to Minimize Oscillation in Ceiling Fans," published Jun. 25, 2009, the disclosure of which is incorporated by reference herein; and WIPO Pub. No. WO/2009/100052, entitled "Automatic Control System for Ceiling Fan Based on Temperature Differentials," published Aug. 13, 2009, the disclosure of which is incorporated by reference herein. Alternatively, any other suitable mounting structures and/or fan systems may be used in conjunction with embodiments described herein.

Some fans may include blades that are formed as a unitary construction. By way of example only, a fan blade may be entirely formed as an extrusion of aluminum or other material. Alternatively, fan blades may be unitarily formed using a variety of other techniques and/or materials, including combinations thereof. In some settings, it may be desirable to provide a fan blade formed of different components, some of which may be formed of material(s) that differ from material (s) of which other components of the fan blade are formed. For instance, it may be desirable in some settings to provide modular fan blade components that permit various fan blades to be modified with relative ease. By way of example only, in some settings, differing components of a fan blade may be configured to reduce the total weight of the fan blade; provide a soft leading edge for the fan blade (e.g., for durability, safety, and/or other purposes); permit tailoring of the aerodynamics of the fan blade to specific applications by interchanging leading and/or trailing edge components; permit tailoring the aerodynamics along the length of a fan blade by combining shorter segments of leading or trailing edge components of different designs in a single assembly; provide different colors within a fan blade (e.g., for visibility, aesthetics, and/or other purposes); and/or provide transparent or translucent segments within a fan blade (e.g., to contain lighting, for visibility, for aesthetics, and/or for other purposes). Of course, differing components of a fan blade may be configured and used for a variety of other purposes, in addition to or in lieu of any of the merely illustrative examples noted above.

While a variety of fans and fan systems have been made and used, it is believed that no one prior to the inventors has made or used a fan system as described herein.

BRIEF DESCRIPTION OF THE DRAWINGS

It is believed the present invention will be better understood from the following description of certain examples taken in conjunction with the accompanying drawings, in which like reference numerals identify the same elements and in which.

Figure 1:
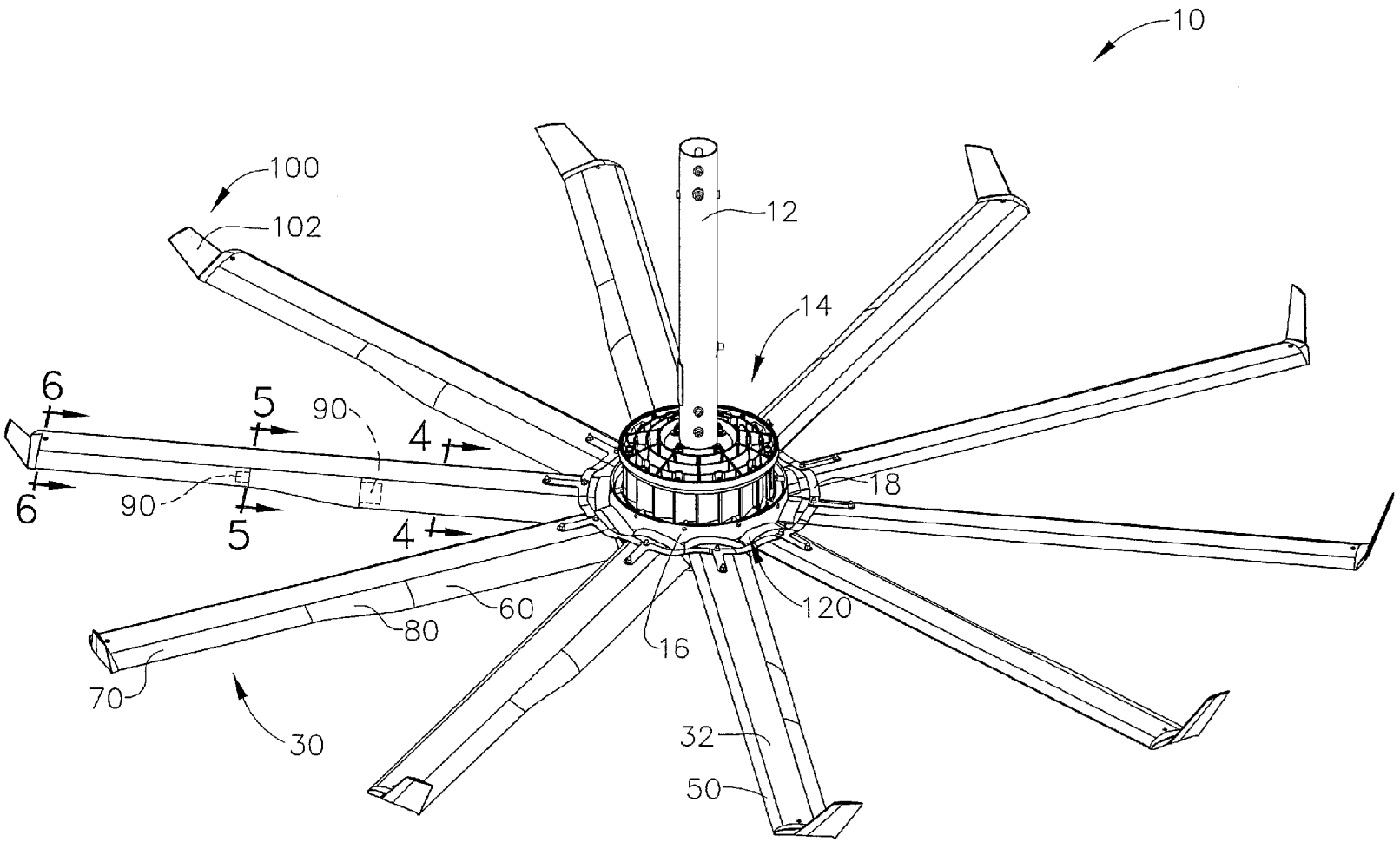
FIG. 1 depicts a perspective view of an exemplary fan system.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description, which includes by way of illustration, one or more of the best modes contemplated for carrying out the invention. As will be realized, the invention is capable of other different and obvious aspects, all without departing from the invention. Accordingly, the drawings and descriptions should be regarded as illustrative in nature and not restrictive.

As shown in FIG. 1, an exemplary fan (10) includes a support (12), a motor (14), a hub (16), and a plurality of fan blades (30). Support (12) is configured to be coupled with a ceiling structure, such that fan (10) may be suspended from a ceiling. Support (12) may be constructed and/or operable in accordance with the teachings of any of the patents, patent publications, or patent applications cited herein. Fan blades (30) extend radially outwardly from hub (16), and motor (14) is operable to rotate hub (16) with fan blades (30). A trim piece (120) is provided at the interface of each fan blade (30) and hub (16). In addition, straps (18) are secured to fan blades (30). A winglet (100) is coupled with the free end of each fan blade (30). Any of these components, among other components that fan (10) may have as desired, may be constructed and/or operable in accordance with the teachings of any of the patents, patent publications, or patent applications cited herein. Indeed, various ways in which the teachings of the patents, patent publications, or patent applications cited herein may be combined with the teachings of the present application will be apparent to those of ordinary skill in the art. By way of example only, support (12), motor (14), hub (16), and straps (18), among other components of fan (10), may be constructed, assembled, and/or used in accordance with the teachings of U.S. Pub. No. 2009/0208333, entitled "Ceiling Fan System with Brushless Motor," published Aug. 20, 2009, the disclosure of which is incorporated by reference herein. Alternatively, these components may be constructed, assembled, and/or used in accordance with the teachings of any other patent, patent publication, or patent application cited herein; or in any other suitable fashion.

In some versions, hub (16) and fan blades (30) are configured such that fan (10) has a diameter of approximately 8 feet. In some other variations, fan (10) has a diameter between approximately 6 feet, inclusive, and approximately 24 feet, inclusive. Alternatively, fan (10) may have any other suitable dimensions.

As shown in FIGS. 1-6, each fan blade (30) of the present example comprises a central spine member (32), a leading edge member (50), and three different types of trailing edge members (60, 70, 80). Each of these exemplary components will be described in greater detail below. Due to the configuration of trailing edge members (60, 70, 80) in this example, the cross section of fan blade (30) varies along the length of fan blade (30). As shown, trailing edge member (60) provides a relatively broad chord section along a first length of fan blade (30); while trailing edge member (70) provides a relatively narrow chord section along a second length of fan blade (30); and trailing edge member (80) provides a substantially smooth transition from the broad chord section to the narrow chord section. In this example, the broad chord section is closer to hub (16); while the narrow chord section is closer to winglet (100); and the transition area is approximately midway along the length of blade (30) between hub (16) and winglet (100). However, it should be understood that, to the extent that two or more trailing edge members (60, 70, 80) are used, blade (30) may alternatively have a broader chord near winglet (100) and a narrower chord near hub (16). Similarly, to the extent that any type of transition trailing edge member (80) is used, such a transition trailing edge member (80) may be located at any other suitable position along the length of blade (30).

Spine member (32) of the present example includes a leading edge engagement channel (34) and a trailing edge engagement channel (36). Leading edge engagement channel (34) is defined in part by an upper projection (40) and a lower projection (42). Upper projection (40) includes a downwardly projecting portion while lower projection (42) includes an upwardly projecting portion. As will be described in greater detail below, leading edge engagement channel (34) is configured to receive leading edge engagement section (52) of leading edge member (50). In particular, projections (54, 56) of leading edge member (50) engage with projections (40, 42) of spine member (32). Similarly, trailing edge engagement channel (36) is defined in part by an upper projection (44) and a lower projection (46). Upper projection (44) includes a downwardly projecting portion while lower projection (46) includes an upwardly projecting portion. As will also be described in greater detail below, trailing edge engagement channel (36) is configured to receive trailing edge engagement sections (62, 72, 82) of trailing edge members (60, 70, 80). In particular, projections (64, 66, 74, 76, 84, 86) of trailing edge members (60, 70, 80) engage with projections (44, 46) of spine member (32).

Spine member (32) is substantially hollow and substantially rigid in the present example. Alternatively, spine member (32) may have any other suitable properties. In some versions, spine member (32) is formed of aluminum, as a single untwisted piece, using an extrusion process. Of course, any other suitable material or combination of materials and/or manufacturing process(es) and/or number of pieces may be used to form spine member (32). In addition, while spine member (32) of the present example has a substantially uniform cross section along its entire length, other versions of spine member (32) may have a cross section that is not uniform along its entire length.

Spine member (32) of the present example further comprises a pair of bosses (38) extending downwardly from the upper interior surface of spine member (32). In the present example, bosses (38) are configured to engage mounting tabs (not shown) that extend outwardly from hub (16) and that are inserted into the interior of spine member (32) in order to mount fan blades (30) to hub (16). In addition, bosses (38) engage winglet (100) as will be described in greater detail below. It should be understood that, as with other components described herein, bosses (38) are merely optional. Indeed, some versions of spine member (32) may lack a hollow interior. Various other suitable ways in which spine member (32) may be configured will be apparent to those of ordinary skill in the art in view of the teachings herein.

As noted above, and with reference to FIGS. 2-11, leading edge member (50) of the present example comprises a leading edge engagement section (52). Leading edge engagement section (52) comprises an upper projection (54) and a lower projection (56). Upper projection (54) includes an upwardly projecting portion while lower projection (56) includes a downwardly projecting portion. As also noted above, leading edge member (50) and spine member (32) are configured such that leading edge engagement section (52) of leading edge member (50) may be inserted into leading edge engagement channel (34) of spine member (32) to secure leading edge engagement member (50) to spine member (32). In particular, and as will be described in greater detail below, projections (54, 56) of leading edge member (50) engage with projections (44, 46) of spine member (32).

Leading edge member (50) is substantially resilient in the present example. Alternatively, leading edge member (50) may have any other suitable properties, including but not limited to flexible, semi-flexible, or semi-rigid, etc. In some versions, leading edge member (50) is formed of plastic, as a single unitary piece, using an extrusion process. Of course, any other suitable material or combination of materials and/or manufacturing process(es) and/or number of pieces may be used to form leading edge member (50). In addition, while leading edge member (50) of the present example has a substantially uniform cross section along its entire length, other versions of leading edge member (50) may have a cross section that is not uniform along its entire length.

Figure 4:
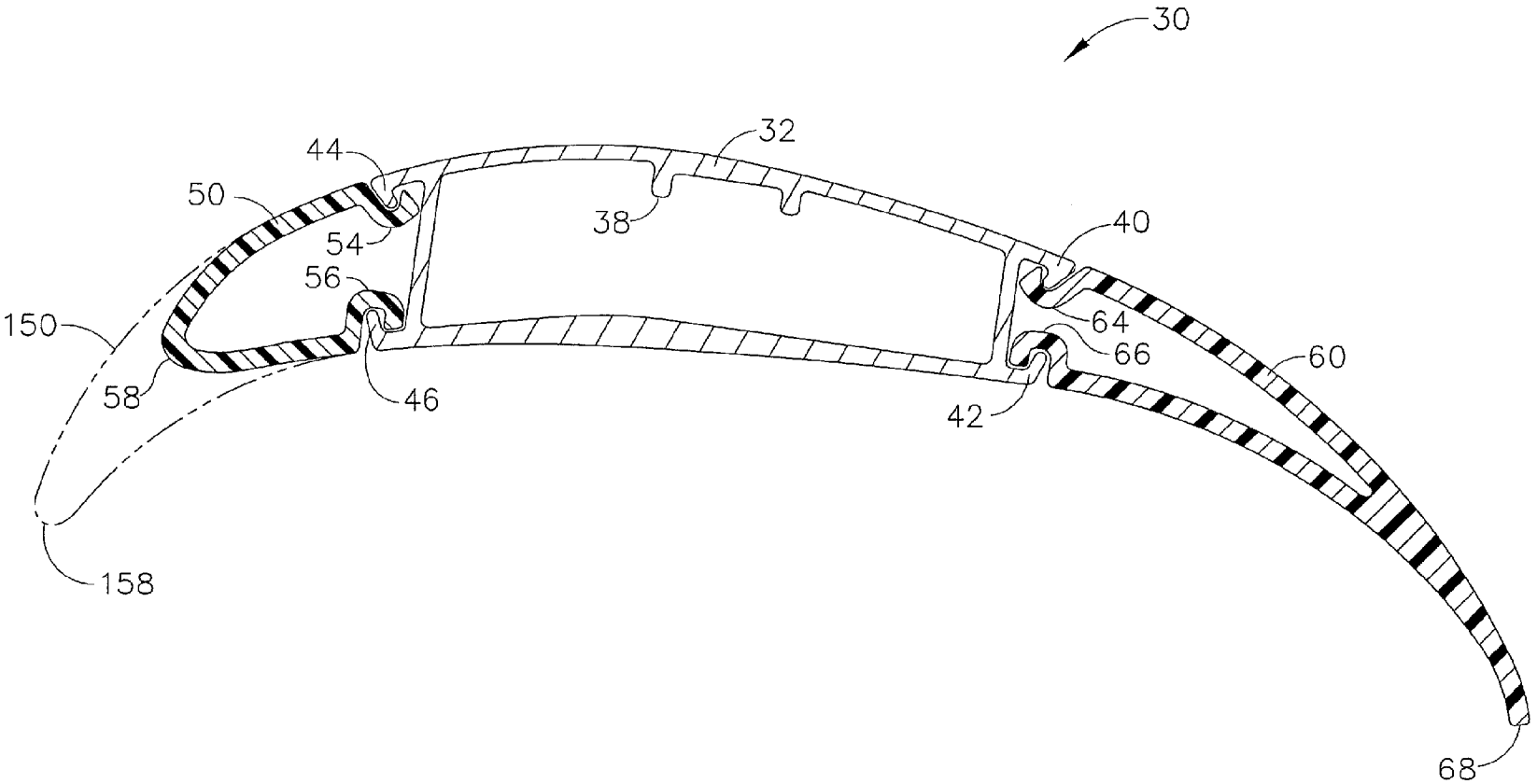
FIG. 4 depicts a cross-sectional view, taken along line 4-4 of FIG. 1, of the fan blade components of FIG. 3, with the leading edge and trailing edge components joined to the spine component.
Figure 5:
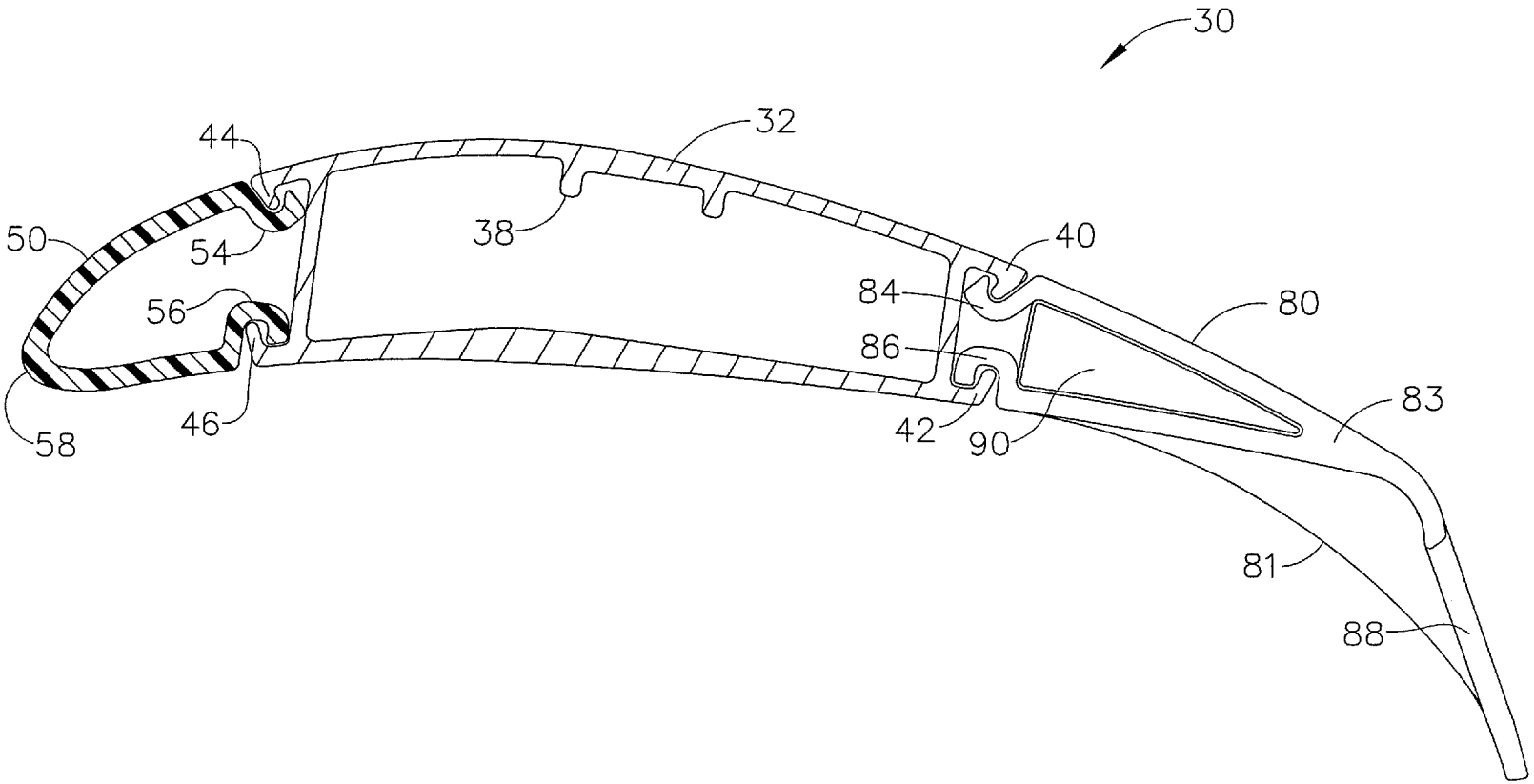
FIG. 5 depicts a cross-sectional view, taken along line 5-5 of FIG. 1, of fan blade components.
Figure 6:
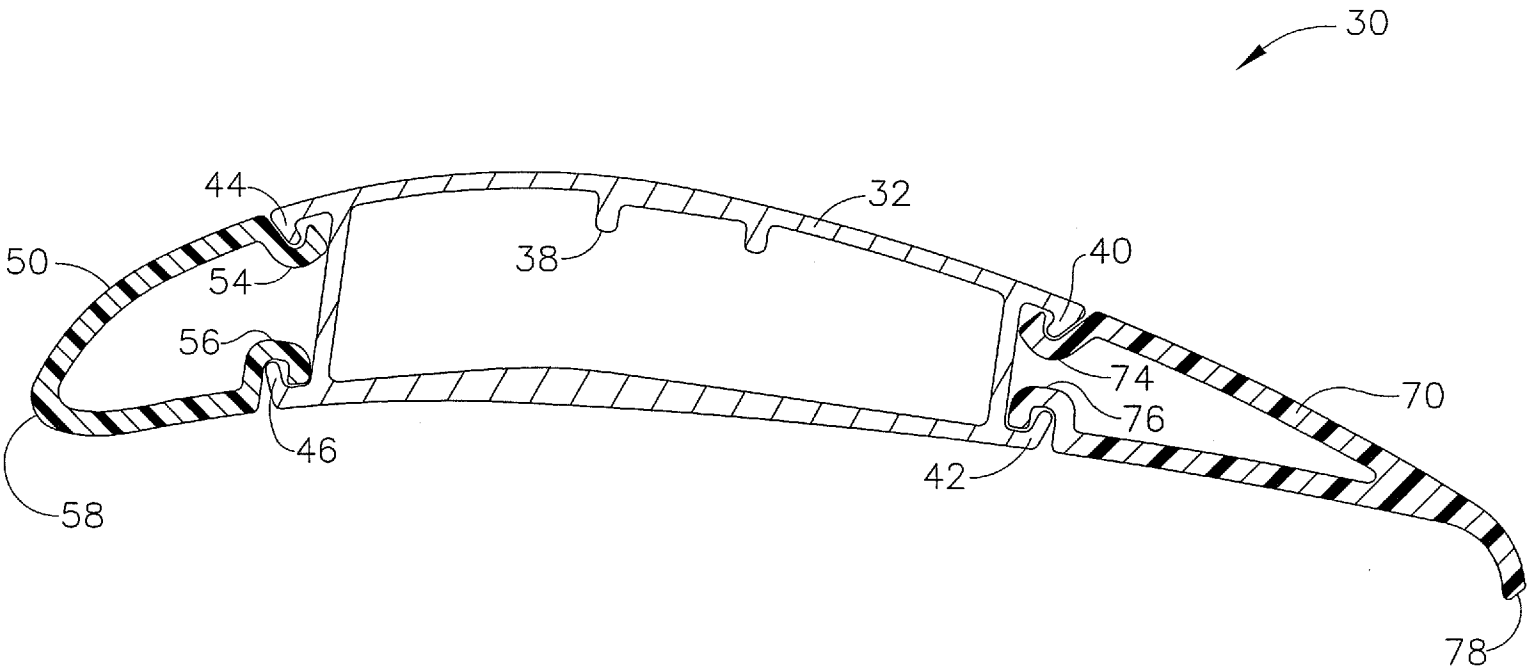
FIG. 6 depicts a cross-sectional view, taken along line 6-6 of FIG. 1, of fan blade components.

Leading edge member (50) may be secured to spine member (32) in a variety of ways. By way of example only, leading edge member (50) and spine member (32) may be initially separated with a distal longitudinal end of leading edge member (50) being positioned adjacent to a proximal longitudinal end of spine member (32), with leading edge engagement section (52) being positioned for receipt in leading edge engagement channel (34). Leading edge member (50) may then be slid distally in a longitudinal direction, with leading edge engagement section (52) being received in leading edge engagement channel (34) as shown in FIGS. 4-6, until the distal longitudinal end of leading edge member (50) reaches the distal longitudinal end of spine member (32). In other words, leading edge member (50) may be coupled with spine member (32) by relative movement between leading edge member (50) and spine member (32) in a direction that is substantially parallel to the longitudinal axis of spine member (32).

As another merely illustrative example of how leading edge member (50) may be coupled with spine member (32), leading edge member (50) may be initially positioned adjacent to spine member (32) at a longitudinal position that is substantially common with the longitudinal position of spine member (32). In other words, the distal longitudinal end of leading edge member (50) may be at approximately the same longitudinal position as the distal longitudinal end of spine member (32); while the proximal longitudinal end of leading edge member (50) is at approximately the same longitudinal position as the proximal longitudinal end of spine member (32). Then, leading edge member (50) may be moved toward spine member (32) in a direction that is transverse or substantially perpendicular to the longitudinal axis of spine member (32). The leading edge (58) of leading edge member (50) may be tipped slightly downward during such movement, such that lower projection (56) of leading edge member (50) first engages lower projection (46) of spine member (46). In particular, a recessed portion of lower projection (56) may receive a complementary upwardly extending portion of lower projection (46). With lower projections (46, 56) substantially engaged along the length of spine member (32) and leading edge member (50), leading edge member (50) may then be rotated relative to spine member (32) to bring upper projection (54) of leading edge member (50) toward upper projection (44) of spine member (32). After upper projections (44, 54) make initial contact and the assembler continues to rotate leading edge member (50) toward spine member (32), the upper portion of leading edge member (50) may deform slightly to allow the downwardly projecting portion of upper projection (44) to be fully received in the complementary recess formed in upper projection (54). Once the downwardly projecting portion of upper projection (44) has been received in the complementary recess formed in upper projection (54), the resilience of leading edge member (50) may urge upper projection (54) back upwardly, providing a substantially secure coupling of upper projections (44, 54).

In some versions, the assembler (e.g., a person and/or machine who assembles fan blade (30), etc.) may squeeze the top portion of leading edge member (50) toward the bottom portion of leading edge member (50) in order to allow upper projection (54) to "clear" upper projection (44); then relax the grip on leading edge member (50) to allow the resilience of leading edge member (50) to urge upper projection (54) upwardly into full engagement with upper projection (44). In the present example, upper projections (44, 54) include complementary ramped surfaces (45, 55). Ramped surfaces (45, 55) are configured to drive upper projection (54) downward when upper projection (54) initially contacts upper projection (44) and leading edge member (50) continues to be rotated toward spine member (32). In some versions, the presence and configuration of ramped surfaces (45, 55) is such that the assembler need not even squeeze leading edge member (50) in order to allow upper projection (54) to "clear"

upper projection (44). In other words, in some versions the presence and configuration of ramped surfaces (45, 55) is such that the assembler need only continue rotating leading edge member (50) toward spine member (32) after lower projections (46, 56) have engaged, in order for upper projections (44, 54) to ultimately engage in a substantially secure fashion (e.g., upper projection (54) "snapping" into place, etc.).

Of course, as with various other components and features described herein, ramped surfaces (45, 55) may be omitted. For instance, the configurations of upper projections (44, 54) may be substantially identical to the configurations of lower projections (46, 56). Another alternative configuration may include reversing the configurations of upper projections (44, 54) with the configurations of lower projections (46, 56), such that lower projections include ramped surfaces (45, 55). It should therefore be understood that, regardless of whether ramped surfaces (45, 55) are included, an alternative assembly technique may include first engaging upper projections (44, 54), then rotating the bottom portion of leading edge member (50) to subsequently engage lower projections (46, 56).

As described above, leading edge member (50) may be coupled with spine member (32) by moving leading edge member (50) toward spine member (32) in a direction substantially perpendicular to the longitudinal axis of spine member (32). Some versions of this technique may include rotation of leading edge member (50) toward spine member after a first set of complementary projections (44, 54 or 46, 56) are engaged, in order to fully engage the other set of complementary projections (46, 56 or 54, 44). As also described above, this technique may include deformation of at least part of leading edge member (50) in order for all complementary projections (44, 54 and 46, 56) to be fully engaged, with the resilience of leading edge member (50) causing leading edge member (50) to "recover" from such deformation and complete the engagement. It should be understood that, in some settings, coupling through a motion that is transverse or substantially perpendicular to the longitudinal axis of spine member (32) may be preferable over coupling through a motion that is substantially parallel to the longitudinal axis of spine member (32). For instance, when each fan blade (30) is substantially long (e.g., approximately 12 feet long, etc.), engagement through a substantially perpendicular motion may be relatively easier than engagement through a substantially parallel motion. For instance, such perpendicular engagement may be better to accommodate components that have been stretched or compressed and/or to account for dimensional mismatch and/or instability. Alternatively, such perpendicular engagement may offer other advantages over parallel engagement; or no advantages over parallel engagement.

It should also be understood that, when an assembly technique incorporating the above described perpendicular motion is used, the entire length of leading edge member (50) need not be fully engaged to spine member (32) at the same time. For instance, the assembler may first engage lower projections (46, 56) along the entire length of leading edge member (50) and spine member (32). The assembler may then start at one end of leading edge member (50) and spine member (32) and fully engage upper projections (44, 54) along just part of the length of leading edge member (50) and spine member (32); then work down the length of leading edge member (50) and spine member (32) to progressively engage upper projections (44, 54) until the assembler reaches the other end of leading edge member (50) and spine member (32), whereupon upper projections (44, 54) will be fully engaged along the full length of leading edge member (50) and spine member (32).

In addition, regardless of the technique used by the assembler to secure leading edge member (50) to spine member (32), the assembler may place an insert (not shown) within the hollow interior of leading edge member (50) after leading edge member (50) has been secured to spine member (32). Such an insert may be inserted in leading edge member (50) using a motion that is substantially parallel to the longitudinal axis of spine member (32). Such an insert may have a shape that complements the shape of the interior of leading edge member (50), such that the presence of the insert in the interior of leading edge member (50) prevents leading edge member (50) from being compressed. In other words, the insert may prevent the top portion of leading edge member (50) from being bent toward the bottom portion of leading edge member (50), which might otherwise disengage upper projections (44, 54) and/or lower projections (46, 56). An insert may thus prevent inadvertent decoupling of leading edge member (50) from spine member (32). Such an insert may extend the entire length of leading edge member (50), a substantial portion of the length of leading edge member (50), or just a relatively small part of the length of leading edge member (50). In addition, in versions where an insert is used in leading edge member (50), such an insert may be secured to leading edge member (50) and/or to spine member (32) using any suitable components, features, or techniques, including but not limited to fasteners (e.g., clips, clamps, screws, bolts, rivets, etc.), adhesives, snap-fitting, interference fitting, etc. Of course, as with other features and components described herein, such an insert is merely optional.

While several structures, features, and techniques for securing leading edge member (50) to spine member (32) have been described above, it should be understood that such structures, features, and techniques are merely illustrative examples. Various other suitable structures, features, and techniques for securing leading edge member (50) to spine member (32) will be apparent to those of ordinary skill in the art in view of the teachings herein.

It should also be understood that leading edge member (50) may be decoupled from spine member (32) in a variety of ways, several of which may result in substantially no damage to leading edge member (50) or spine member (32). Such decoupling may be performed in order to replace leading edge member (50), such as to replace a leading edge member (50) that has sustained some type of damage, or to use a leading edge member (50) that has a different configuration. For instance, phantom lines in FIG. 4 show an alternative leading edge member (150) having a configuration that substantially differs from the configuration of leading edge member (50), with a leading edge (158) that "droops" downwardly more than leading edge (58). Of course, an alternative leading edge member (150) may have a variety of other configurations. Alternative leading edge member (150) of this example also has an upper projection (54) and a lower projection (56) that is similar to the same components of leading edge member (50), such that the alternative leading edge member (150) may be coupled with and decoupled from spine member (32) just like leading edge member (50) as described herein.

As one merely illustrative example of decoupling, the top portion of a leading edge member (50, 150) may be squeezed toward the bottom portion of leading edge member (50, 150) until upper projection (54) is lowered relative to upper projection (44) enough to allow the top portion of leading edge member (50, 150) to be rotated away from spine member (32). Once upper projection (54) has sufficiently cleared upper projection (44) after sufficient rotation of leading edge member (50, 150), lower projections (46, 56) may be decoupled with relative ease, and leading edge member (50, 150) may be pulled away from spine member (32). In other words, leading edge member (50, 150) may be decoupled from spine member (32) by moving leading edge member (50, 150) in a direction that is substantially perpendicular to the longitudinal axis of spine member (32). Leading edge member (50, 150) may thus be decoupled from spine member (32) simply by reversing the steps described above for coupling leading edge member (50) with spine member (32). To the extent that an insert has been positioned within leading edge member (50, 150) as described above (e.g., after leading edge member (50, 150) has been coupled with spine member (32)), such an insert may be removed from leading edge member (50, 150) before decoupling leading edge member (50, 150) from spine member (32) using the technique described in this paragraph.

As another merely illustrative example of decoupling, leading edge member (50, 150) may be pushed or pulled longitudinally relative to spine member (32) until the proximal end of leading edge member (50, 150) has cleared the distal end of spine member (32) or vice versa. In other words, leading edge member (50, 150) may be decoupled from spine member (32) by moving leading edge member (50, 150) in a direction that is substantially parallel to the longitudinal axis of spine member (32). To the extent that an insert has been positioned within leading edge member (50, 150) as described above (e.g., after leading edge member (50, 150) has been coupled with spine member (32)), such an insert may remain positioned in leading edge member (50, 150) during performance of the decoupling technique described in this paragraph or may be removed beforehand. Still other suitable ways in which a leading edge member (50, 150) may be decoupled from a spine member (32) will be apparent to those of ordinary skill in the art in view of the teachings herein.

Figure 2:
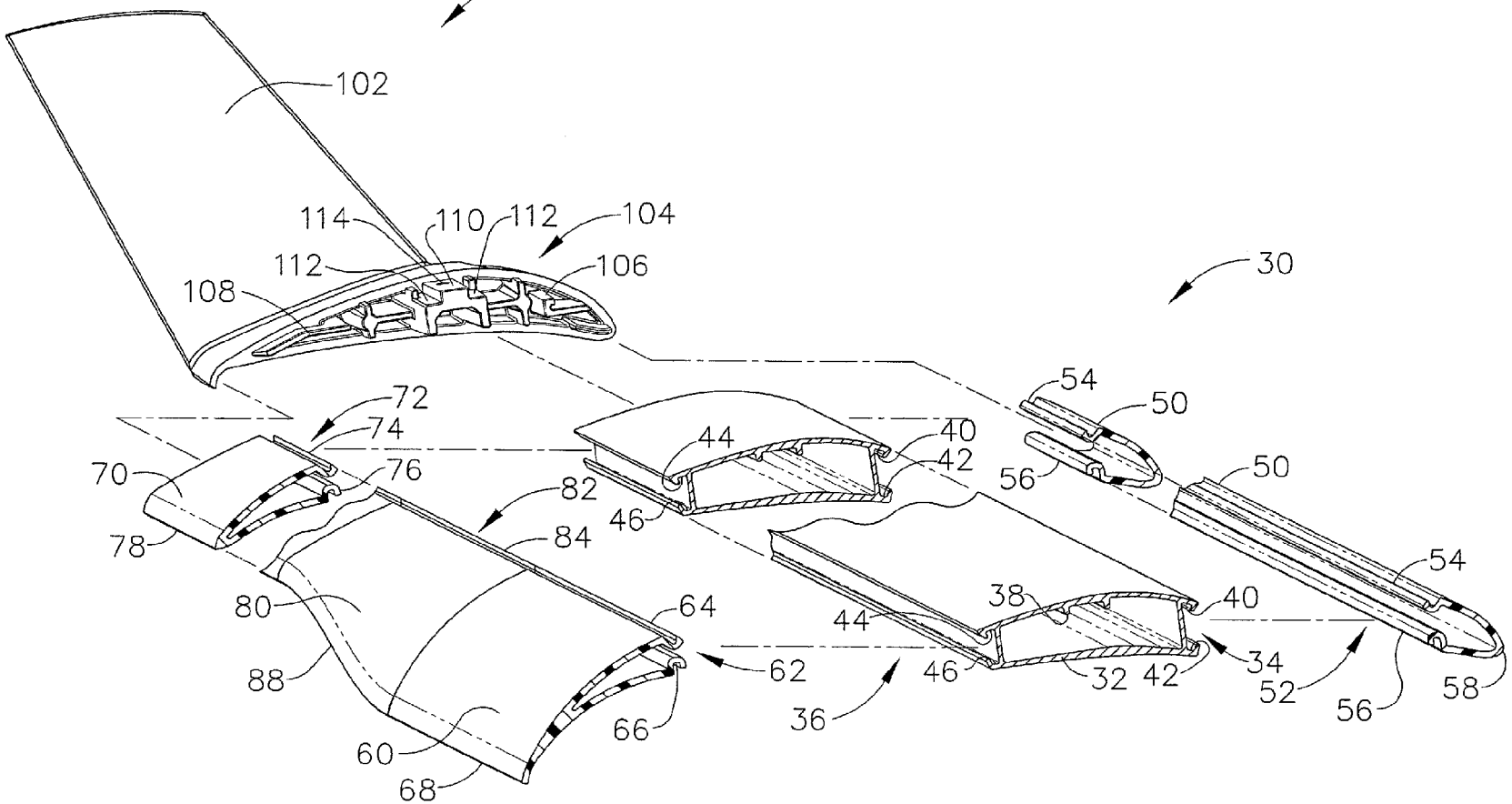
FIG. 2 depicts an exploded view of fan blade components of the fan system of FIG. 1.
Figure 3:
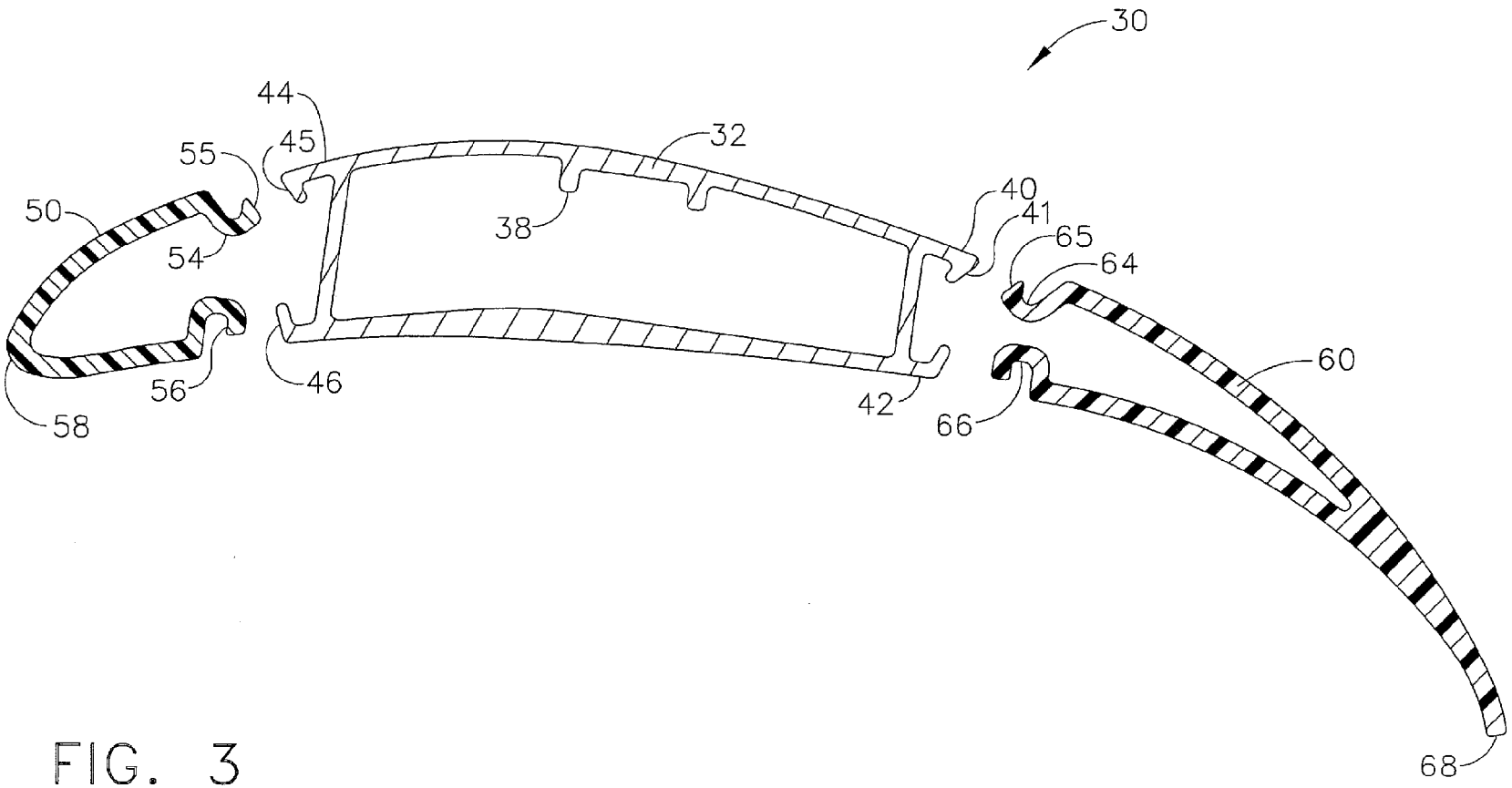
FIG. 3 depicts a cross-sectional view of fan blade components of the fan system of FIG. 1, with a leading edge component and a broad chord trailing edge component separated from a spine component.

As shown in FIGS. 2-4, trailing edge member (60) of the present example comprises a trailing edge engagement section (62). Trailing edge engagement section (62) comprises an upper projection (64) and a lower projection (66). Upper projection (64) includes an upwardly projecting portion while lower projection (66) includes a downwardly projecting portion. Trailing edge member (60) and spine member (32) are configured such that trailing edge engagement section (62) of trailing edge member (60) may be inserted into trailing edge engagement channel (36) of spine member (32) to secure trailing edge engagement member (60) to spine member (32). In particular, projections (64, 66) of trailing edge member (60) may engage with projections (40, 42) of spine member (32).

Trailing edge member (60) is substantially resilient in the present example. Alternatively, trailing edge member (60) may have any other suitable properties, including but not limited to flexible, semi-flexible, or semi-rigid, etc. In some versions, trailing edge member (60) is formed of plastic, as a single unitary piece, using an extrusion process. Of course, any other suitable material or combination of materials and/or manufacturing process(es) and/or number of pieces may be used to form trailing edge member (60). In addition, while trailing edge member (60) of the present example has a substantially uniform cross section along its entire length, other versions of trailing edge member (60) may have a cross section that is not uniform along its entire length. In the present example, trailing edge member (60) has a trailing edge (68) that is substantially lower than the leading edge (58) of leading edge member (50); and provides a relatively broad chord segment of fan blade (30). In some versions, trailing edge member (60) has a cross section that is similar to the cross section of the trailing edge portion of the airfoil disclosed in FIG. 3 and the accompanying description of U.S. Pat. No. 7,284,960, the disclosure of which is incorporated by reference herein. In some other versions, trailing edge member (60) has a cross section that is similar to the cross section of the trailing edge portion of the airfoil disclosed in FIG. 11 or 12 and the accompanying description of U.S. Pub. No. 2008/0008596, the disclosure of which is incorporated by reference herein. Alternatively, trailing edge member (60) may have any other suitable configuration.

Trailing edge member (60) may be coupled with and decoupled from spine member (32) in a variety of ways. For instance, trailing edge member (60) may be coupled with spine member (32) by moving trailing edge member (60) in a direction that is substantially perpendicular to the longitudinal axis of spine member (32), in a manner similar to that described above with respect to leading edge member (50) (e.g., including squeezing trailing edge member (60), etc.). Ramped surfaces (41, 65) of upper projections (40, 64) may thus be used to facilitate a snap fit between trailing edge member (60) and spine member (32). Alternatively, trailing edge member (60) may be coupled with spine member (32) by moving trailing edge member (60) in a direction that is substantially parallel to the longitudinal axis of spine member (32), in a manner similar to that described above with respect to leading edge member (50). Furthermore, an insert may be positioned within trailing edge member (60), before or after trailing edge member (60) is coupled with spine member (32), such as to provide additional rigidity to trailing edge member (60), to reduce the likelihood of inadvertent decoupling of trailing edge member (60) from spine member (32), etc., similar to the insert described above with respect to leading edge member (50). Similarly, trailing edge member (60) may be decoupled from spine member (32) by moving trailing edge member (60) in a direction that is substantially perpendicular to the longitudinal axis of spine member (32) (e.g., including squeezing trailing edge member (60), etc.); or by moving trailing edge member (60) in a direction that is substantially parallel to the longitudinal axis of spine member (32). Trailing edge member (60) may thus be decoupled from spine member (32) in any manner similar to that described above with respect to leading edge member (50). Still other suitable ways in which trailing edge member (60) may be coupled with or decoupled from spine member (32) will be apparent to those of ordinary skill in the art in view of the teachings herein.

As shown in FIGS. 2 and 6, trailing edge member (70) of the present example comprises a trailing edge engagement section (72). Trailing edge engagement section (72) comprises an upper projection (74) and a lower projection (76). Upper projection (74) includes an upwardly projecting portion while lower projection (76) includes a downwardly projecting portion. Trailing edge member (70) and spine member (32) are configured such that trailing edge engagement section (72) of trailing edge member (70) may be inserted into trailing edge engagement channel (36) of spine member (32) to secure trailing edge engagement member (70) to spine member (32). In particular, projections (74, 76) of trailing edge member (70) may engage with projections (40, 42) of spine member (32).

Trailing edge member (70) is substantially resilient in the present example. Alternatively, trailing edge member (70) may have any other suitable properties, including but not limited to flexible, semi-flexible, or semi-rigid, etc. In some versions, trailing edge member (70) is formed of plastic, as a single unitary piece, using an extrusion process. Of course, any other suitable material or combination of materials and/or manufacturing process(es) and/or number of pieces may be used to form trailing edge member (70). In addition, while trailing edge member (70) of the present example has a substantially uniform cross section along its entire length, other versions of trailing edge member (70) may have a cross section that is not uniform along its entire length. In the present example, trailing edge member (70) has a trailing edge (78) that is slightly lower than the leading edge (58) of leading edge member (50); and provides a relatively narrow chord segment of fan blade (30). In some versions, trailing edge member (70) has a cross section that is similar to the cross section of the trailing edge portion of the airfoil disclosed in FIG. 2 and the accompanying description of U.S. Pat. No. 7,284,960, the disclosure of which is incorporated by reference herein. Alternatively, trailing edge member (70) may have any other suitable configuration.

Trailing edge member (70) may be coupled with and decoupled from spine member (32) in a variety of ways. For instance, trailing edge member (70) may be coupled with spine member (32) by moving trailing edge member (70) in a direction that is substantially perpendicular to the longitudinal axis of spine member (32), in a manner similar to that described above with respect to leading edge member (50) (e.g., including squeezing trailing edge member (70), etc.). Ramped surfaces (41, 75) of upper projections (40, 74) may thus be used to facilitate a snap fit between trailing edge member (70) and spine member (32). Alternatively, trailing edge member (70) may be coupled with spine member (32) by moving trailing edge member (70) in a direction that is substantially parallel to the longitudinal axis of spine member (32), in a manner similar to that described above with respect to leading edge member (50). Furthermore, an insert may be positioned within trailing edge member (70), before or after trailing edge member (70) is coupled with spine member (32), such as to provide additional rigidity to trailing edge member (70), to reduce the likelihood of inadvertent decoupling of trailing edge member (70) from spine member (32), etc., similar to the insert described above with respect to leading edge member (50). Similarly, trailing edge member (70) may be decoupled from spine member (32) by moving trailing edge member (70) in a direction that is substantially perpendicular to the longitudinal axis of spine member (32) (e.g., including squeezing trailing edge member (70), etc.); or by moving trailing edge member (70) in a direction that is substantially parallel to the longitudinal axis of spine member (32). Trailing edge member (70) may thus be decoupled from spine member (32) in any manner similar to that described above with respect to leading edge member (50). Still other suitable ways in which trailing edge member (70) may be coupled with or decoupled from spine member (32) will be apparent to those of ordinary skill in the art in view of the teachings herein.

Figure 7:
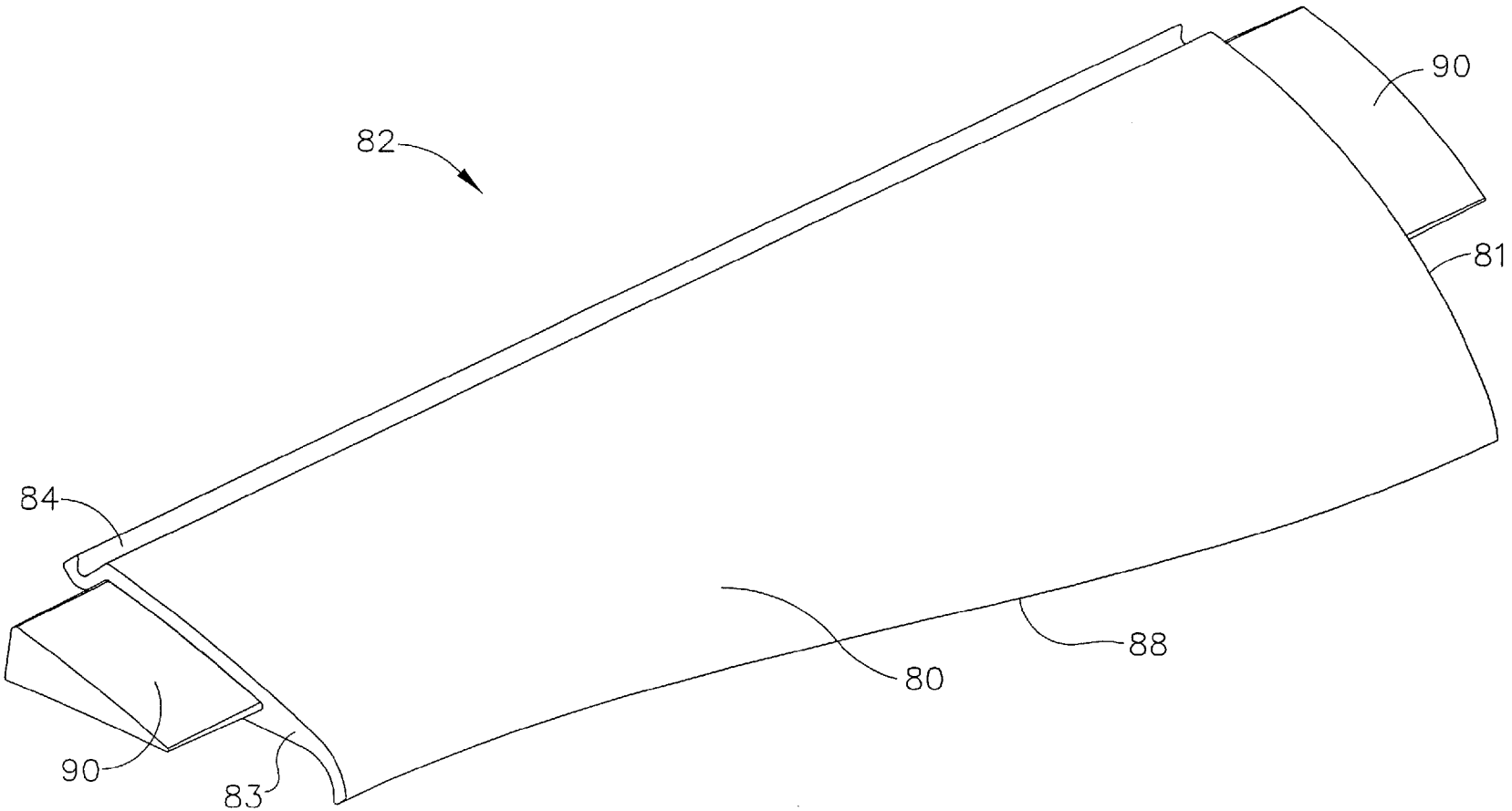
FIG. 7 depicts a perspective view of the transition trailing edge segment of the fan system of FIG. 1.

As shown in FIGS. 2, 5, and 7, trailing edge member (80) of the present example comprises a trailing edge engagement section (82). Trailing edge engagement section (82) comprises an upper projection (84) and a lower projection (86). Upper projection (84) includes an upwardly projecting portion while lower projection (86) includes a downwardly projecting portion. Trailing edge member (80) and spine member (32) are configured such that trailing edge engagement section (82) of trailing edge member (80) may be inserted into trailing edge engagement channel (36) of spine member (32) to secure trailing edge engagement member (80) to spine member (32). In particular, projections (84, 86) of trailing edge member (80) may engage with projections (40, 42) of spine member (32).

Trailing edge member (80) is substantially resilient in the present example. Alternatively, trailing edge member (80) may have any other suitable properties, including but not limited to flexible, semi-flexible, or semi-rigid, etc. In some versions, trailing edge member (80) is formed of plastic, as a single unitary piece, using a molding process. Of course, any other suitable material or combination of materials and/or manufacturing process(es) and/or number of pieces may be used to form trailing edge member (80). As shown in FIGS. 2, 5, and 7, the cross section of trailing edge member (80) of the present example is not uniform along its entire length. In particular, the cross section at proximal end (81) of trailing edge member (80) is substantially identical to the cross section of trailing edge member (60); while the cross section at distal end (83) of trailing edge member (80) is substantially identical to the cross section of trailing edge member (70). Between ends (81, 83) of trailing edge member (80), the trailing edge (88) of trailing edge member (80) (as well as the upper and lower surfaces of trailing edge member (80)) provides a substantially smooth transition from the cross section of trailing edge member (60) to the cross section of trailing edge member (70). In other words, the trailing edge (88) of trailing edge member (80) (as well as the upper and lower surfaces of trailing edge member (80)) follows a curved path along the length of trailing edge member (80), such that the transition from trailing edge member (60) to trailing edge member (70) is not abrupt or "stepped," etc. Alternatively, trailing edge member (80) may have any other suitable configuration.

Trailing edge member (80) may be coupled with and decoupled from spine member (32) in a variety of ways. For instance, trailing edge member (80) may be coupled with spine member (32) by moving trailing edge member (80) in a direction that is substantially perpendicular to the longitudinal axis of spine member (32), in a manner similar to that described above with respect to leading edge member (50) (e.g., including squeezing trailing edge member (80), etc.). Ramped surfaces (41, 85) of upper projections (40, 84) may thus be used to facilitate a snap fit between trailing edge member (80) and spine member (32). Alternatively, trailing edge member (80) may be coupled with spine member (32) by moving trailing edge member (80) in a direction that is substantially parallel to the longitudinal axis of spine member (32), in a manner similar to that described above with respect to leading edge member (50). Furthermore, an insert may be positioned within trailing edge member (80), before or after trailing edge member (80) is coupled with spine member (32), such as to provide additional rigidity to trailing edge member (80), to reduce the likelihood of inadvertent decoupling of trailing edge member (80) from spine member (32), etc., similar to the insert described above with respect to leading edge member (50). Similarly, trailing edge member (80) may be decoupled from spine member (32) by moving trailing edge member (80) in a direction that is substantially perpendicular to the longitudinal axis of spine member (32) (e.g., including squeezing trailing edge member (80), etc.); or by moving trailing edge member (80) in a direction that is substantially parallel to the longitudinal axis of spine member (32). Trailing edge member (80) may thus be decoupled from spine member (32) in any manner similar to that described above with respect to leading edge member (50). Still other suitable ways in which trailing edge member (80) may be coupled with or decoupled from spine member (32) will be apparent to those of ordinary skill in the art in view of the teachings herein.

In addition to being coupled with spine member (32), trailing edge member (80) may be coupled with trailing edge members (60, 70). For instance, FIGS. 5 and 7 show extensions (90) extending distally and proximally from trailing edge member (80). In some versions, extensions (90) are formed as unitary components of trailing edge member (80) (e.g., molded with trailing edge member (80), etc.). In some other versions, extensions (90) are formed as pieces that are separate from trailing edge member (80) then are joined with trailing edge member (80). In the present example, extension (90) at proximal end (81) of trailing edge member (80) is insertable into the interior of trailing edge member (60). Similarly, extension (90) at distal end (81) of trailing edge member (80) is insertable into the interior of trailing edge member (70). The fitting between extensions (90) and trailing edge members (60, 70) may be substantially snug and/or have other characteristics. It should also be understood that extensions (90) may have any suitable length, such that extensions (90) may extend into trailing edge members (60, 70) to any suitable depth.

In some installation techniques, trailing edge members (60, 70, 80) are all three coupled with spine member (32) in a longitudinally spaced apart fashion, such that the proximal end of trailing edge member (60) longitudinally protrudes proximally relative to the proximal end of spine member (32); and such that the distal end of trailing edge member (70) longitudinally protrudes distally relative to the distal end of spine member (32). The distal end of trailing edge member (60) is proximal to the proximal extension (90) of trailing edge member (80); while the proximal end of trailing edge member (70) is distal to the distal extension (90) of trailing edge member (80). Then, trailing edge member (60) is slid distally relative to trailing edge member (80) to effect insertion of the proximal extension (90) of trailing edge member (80) into the interior of trailing edge member (60). Trailing edge member (70) is slid proximally relative to trailing edge member (80) to effect insertion of the distal extension (90) of trailing edge member (80) into the interior of trailing edge member (70). At this stage, the proximal end of trailing edge member (60) may be substantially flush with the proximal end of spine member (32) while the distal end of trailing edge member (60) abuts the proximal end (81) of trailing edge member (80). Similarly, at this stage, the proximal end of trailing edge member (70) may abut the distal end (83) of trailing edge member (80) while the distal end of trailing edge member (70) is substantially flush with the distal end of spine member (32). Of course, the sequence and direction of sliding of trailing edge members (60, 70, 80) may be varied in numerous ways to effect insertion of extensions (90) into the interiors of trailing edge members (60, 70).

It should also be understood that extensions (90) may simply be omitted, if desired. In some versions, extensions (90) are omitted and one or more inserts (such as inserts described above) are inserted through trailing edge members (60, 70, 80). For instance, trailing edge members (60, 80) may "share" a first common insert (e.g., an insert may extend into the interiors of both trailing edge members (60, 80), etc.); while trailing edge members (70, 80) may "share" a second common insert. Alternatively, all trailing edge members (60, 70, 80) may "share" a common insert. It should be understood that such inserts or extensions (90) may provide additional rigidity to trailing edge members (60, 70, 80) and/or may reduce the likelihood of trailing edge members (60, 70, 80) being inadvertently decoupled from spine member (32) (e.g., by keeping upper projections (64, 74, 84) sufficiently separated from lower projections (66, 76, 86), etc.). Furthermore, having one or more inserts or extensions (90) shared by trailing edge members (60, 80) and having one or more inserts or extensions (90) shared by trailing edge members (60, 70) may prevent each trailing edge member (60, 70) from being deflected upwardly or downwardly relative to trailing edge member (80) or vice versa. Such inserts or extensions (90) may thus help maintain substantial continuity among the upper and lower surfaces of trailing edge members (60, 70, 80). Again though, such inserts or extensions (90) are merely optional, and may be varied or modified in a number of ways or simply be omitted.

Figure 8:
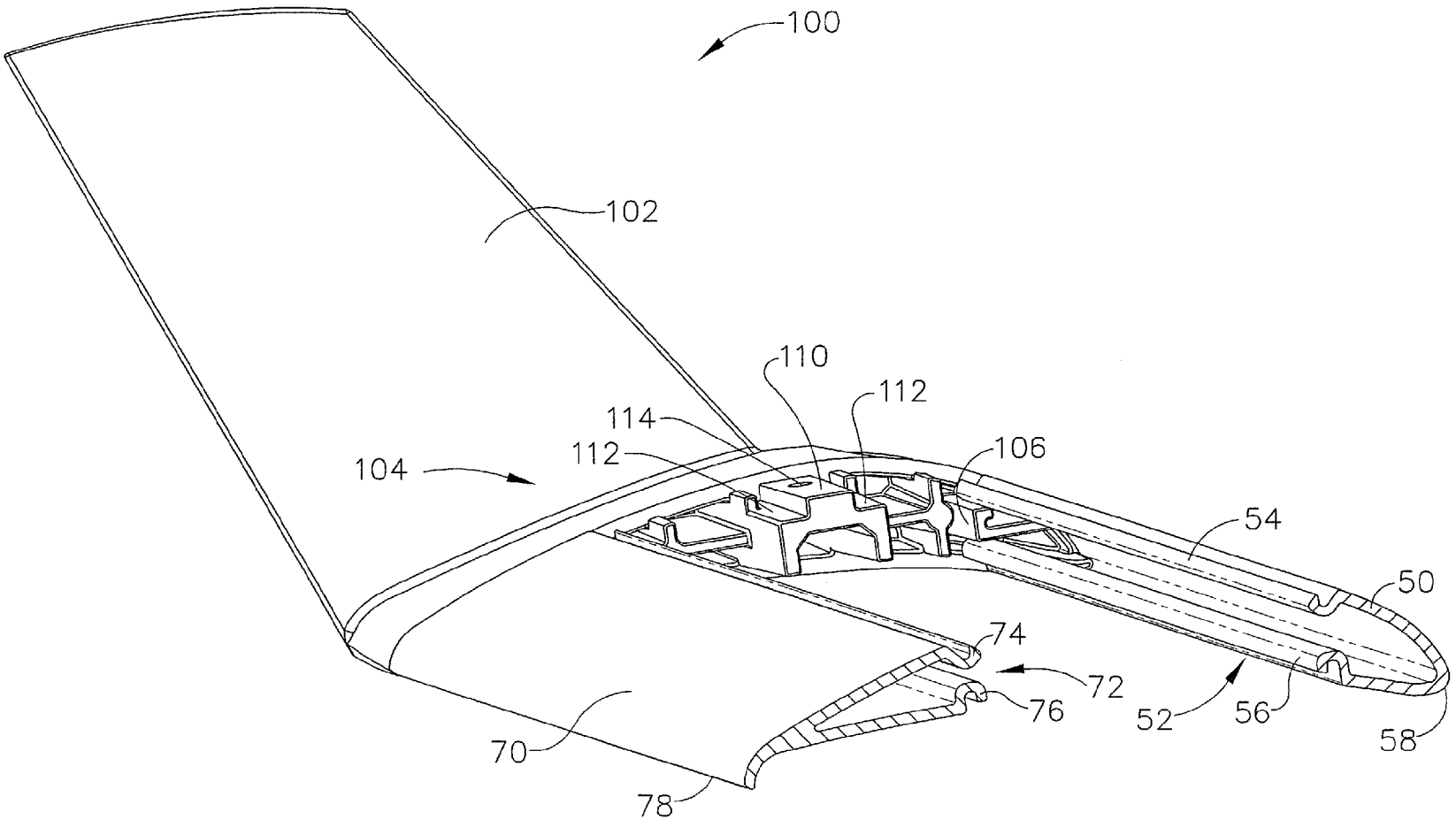
FIG. 8 depicts a partial perspective view of fan blade components of the fan system of FIG. 1, showing leading edge and trailing edge components engaged with a winglet.
Figure 9:
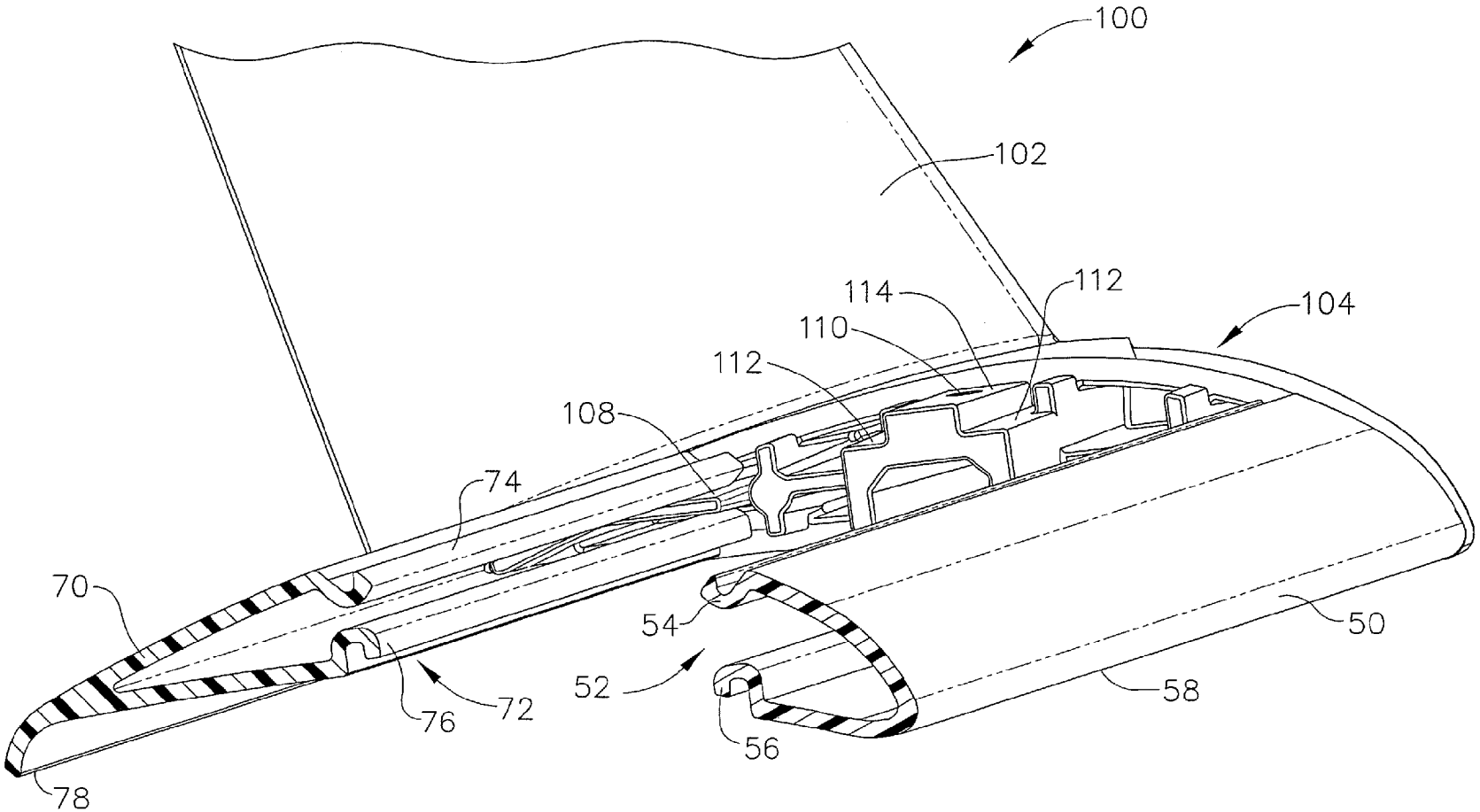
FIG. 9 depicts another partial perspective view of the fan blade components of FIG. 8.

FIGS. 2 and 8-9 show how components of fan blade (30) couple with winglet (100) in the present example. In this example, much of winglet (100) is configured in accordance with the teachings of U.S. Design Pat. No. D587,799, the disclosure of which is incorporated by reference herein. By way of example only, winglet (100) may be substantially rigid and may be formed as a single unitary piece of molded plastic. Of course, any other suitable material or combination of materials and/or manufacturing process(es) and/or number of pieces may be used to form winglet (100), and winglet (100) may have any other suitable characteristics. Winglet (100) of the present example includes a substantially upright portion (102) and a blade mounting portion (104). Substantially upright portion (102) is configured such that its inner surface defines an obtuse angle with the top surface of fan blade (30), though substantially upright portion (102) may have any other suitable orientation or configuration. Blade mounting portion (104) of the present example includes a leading edge member boss (106), a trailing edge member boss (108), and a spine member boss (110). Bosses (106, 108, 110) are substantially rigid in the present example, though bosses (106, 108, 110) may have any other suitable properties. Indeed, bosses (106, 108, 110) may be varied, substituted, or supplemented in any suitable fashion; or even be omitted.

As shown in FIGS. 2 and 8, leading edge member boss (106) is configured to extend proximally in the interior of leading edge member (50). Leading edge member boss (106) is sized and configured to keep projections (54, 56) of leading edge member (50) separated. Leading edge member boss (106) may thus help maintain engagement between projections (54, 56) of leading edge member (50) and projections (40, 42) of spine member (32); thereby reinforcing the coupling of leading edge member (50) with spine member (32). Similarly, and as shown in FIGS. 2 and 9, trailing edge member boss (108) is configured to extend proximally in the interior of trailing edge member (70). Trailing edge member boss (108) is sized and configured to keep projections (74, 76) of trailing edge member (70) separated. Trailing edge member boss (108) may thus help maintain engagement between projections (74, 76) of trailing edge member (70) and projections (44, 46) of spine member (32); thereby reinforcing the coupling of trailing edge member (70) with spine member (32).

Spine member boss (110) is configured to extend proximally in the interior of spine member (32). Spine member boss (110) includes a pair of recessed portions (112) and an opening (114). Recessed portions (112) are configured to receive downwardly projecting bosses (38) of spine member (32). Opening (114) is configured to align with a complementary opening (not shown) at the distal end of spine member (32), such that a fastener (e.g., screw, bolt, etc.) may be fed through aligned openings to secure winglet (100) to spine member (32). Of course, winglet (100) may engage with and be secured to spine member (32) in a variety of other ways, as will be apparent to those of ordinary skill in the art in view of the teachings herein.

In some alternative versions, winglet (100) includes a cuff extending proximally over part of the exterior of fan blade (30). For instance, winglet (100) may include a cuff as taught in U.S. Pub. No. 2008/0014090, the disclosure of which is incorporated by reference herein. Such a cuff may further reinforce couplings of leading edge member (50) and trailing edge members (60, 70, 80) with spine member (32). Of course, any other suitable type of cuff may be incorporated, as part of winglet (100) or otherwise; or cuffs may simply be omitted if desired.

It should be understood that, as with other components described herein, winglet (100) is merely optional, and winglet (100) may be varied, substituted, or supplemented in a variety of ways, if not be omitted altogether. For instance, in some versions, winglet (100) is omitted, and a simple end cap is secured to the distal end of each fan blade (30). For instance, such an end cap may lack a substantially upright portion (102) yet include a portion that is similar to blade mounting portion (104) as described above. Alternatively, an end cap may have any other suitable configuration. Still other suitable variations, substitutes, or supplements for a winglet (100) will be apparent to those of ordinary skill in the art in view of the teachings herein.

To the extent that winglets (100) are used, it should be understood that components of fan blades (30) may be secured to each other in a variety of sequences relative to the securing of winglets (100) to fan blades (30). For instance, in some versions, each fan blade (30) is fully assembled (e.g., leading edge members (50) and trailing edge members (60, 70, 80) are secured to spine members (32), etc.) before winglets (100) are secured to fan blades (30). In some other versions, winglets (100) are first mounted to spine members (32). Then, leading edge members (50) and trailing edge members (60, 70, 80) are secured to spine members (32). In some versions of this technique, leading edge members (50) and trailing edge members (60, 70, 80) are initially secured to spine members (32) just proximal to blade mounting portion (104); and then leading edge members (50) and trailing edge members (60, 70, 80) are slid distally along the remaining length of their corresponding spine members (32) until bosses (106, 108) are effectively inserted in the interiors of leading edge members (50) and trailing edge members (70). Still other suitable assembly techniques will be apparent to those of ordinary skill in the art in view of the teachings herein.

Figure 10:
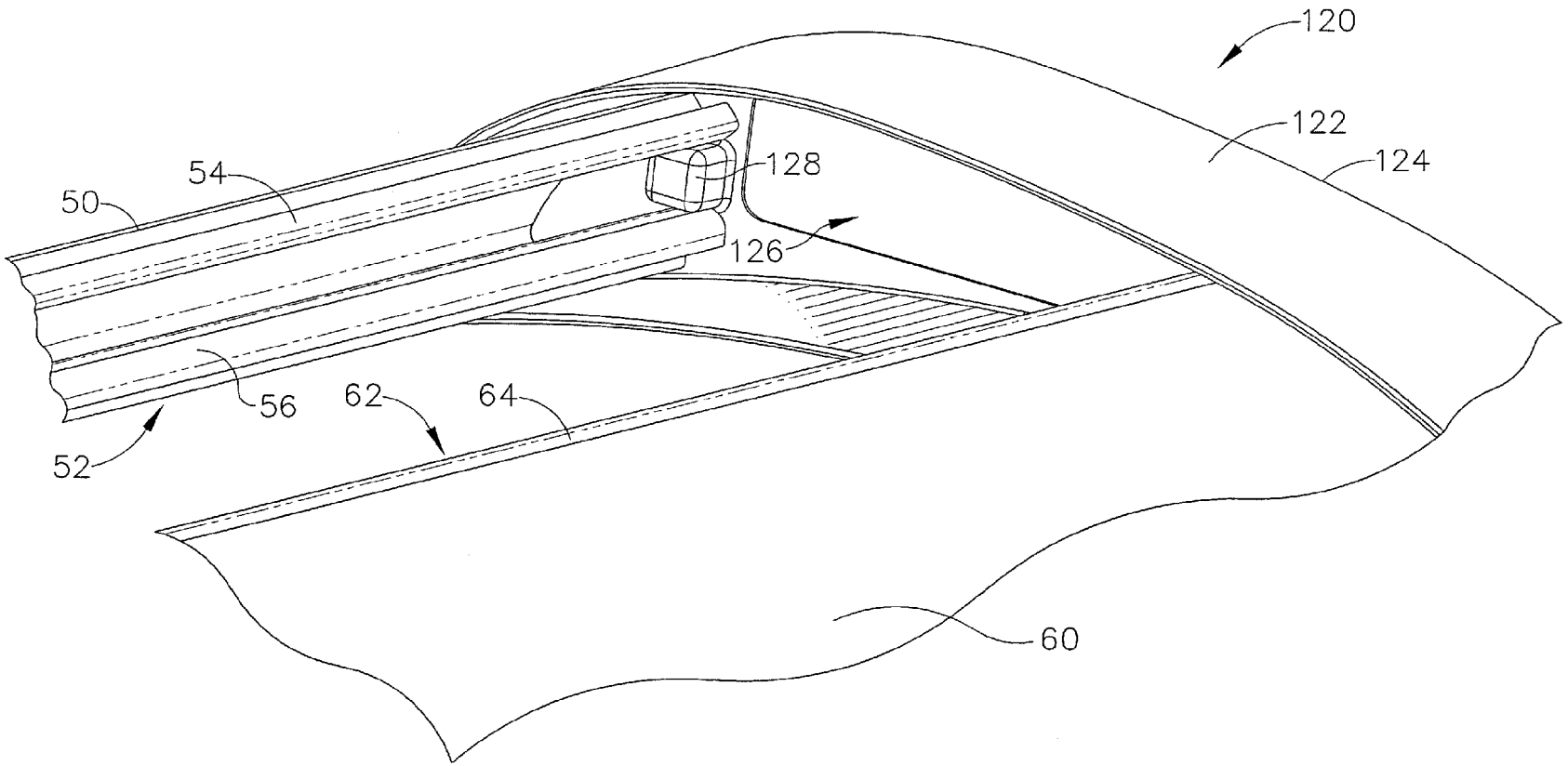
FIG. 10 depicts a partial perspective view of fan blade components of the fan system of FIG. 1, showing leading edge and trailing edge components engaged with a hub trim piece.
Figure 11:
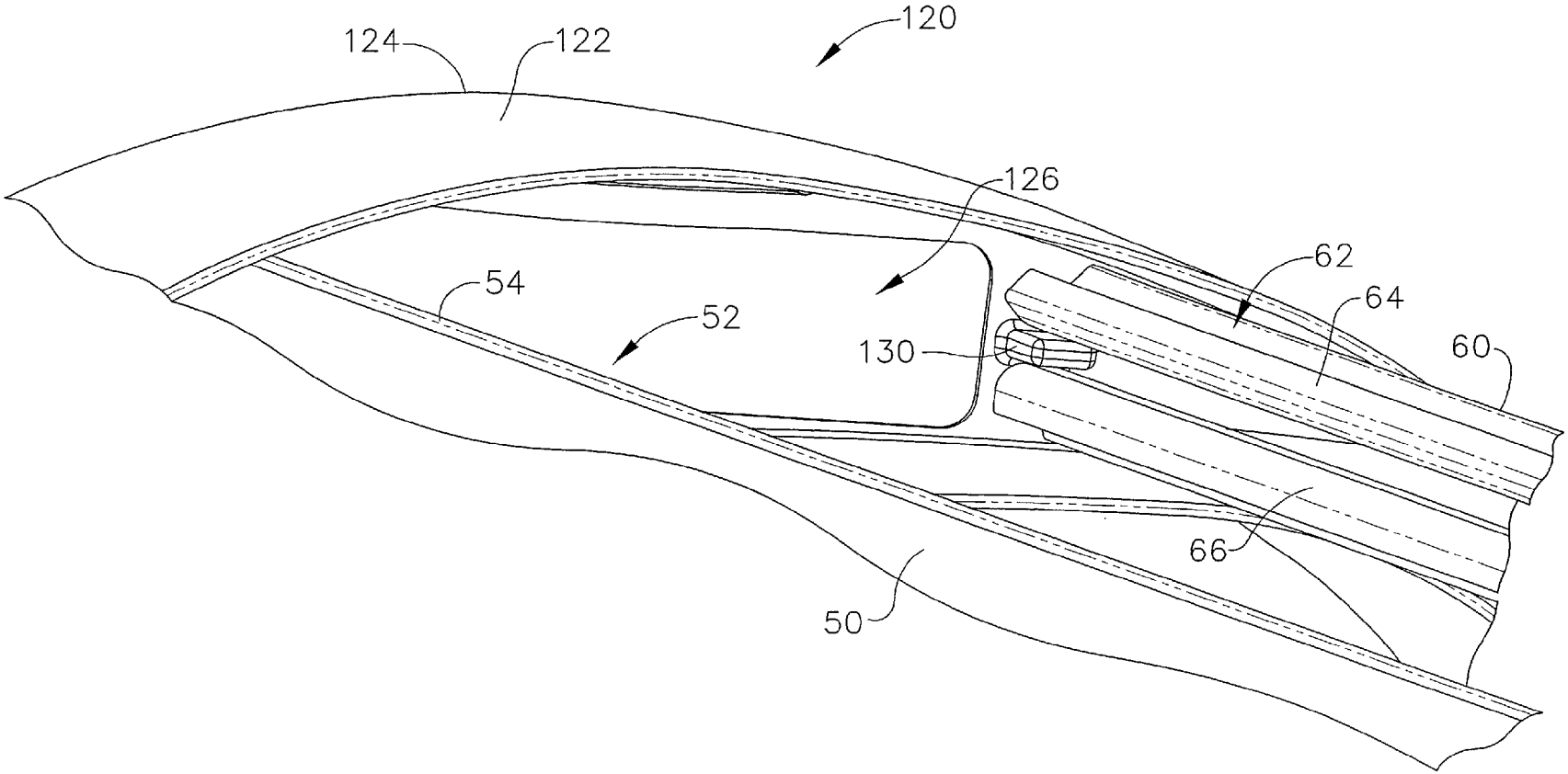
FIG. 11 depicts another partial perspective view of the fan blade components of FIG. 10.

FIGS. 10-11 show how components of fan blade (30) couple with trim piece (120) in the present example. By way of example only, trim piece (120) may be substantially rigid and may be formed as a single unitary piece of molded plastic. Of course, any other suitable material or combination of materials and/or manufacturing process(es) and/or number of pieces may be used to form trim piece (120), and trim piece (120) may have any other suitable characteristics. Trim piece (120) of the present example includes a cuff portion (122) and a hub interface portion (124). Trim piece (120) defines an opening (126). A plurality of mounting tabs (not shown) extend radially outwardly from hub (16); such that fan blades (30) are mounted to hub (16) by securing spine members (32) to corresponding mounting tabs of hub (16). Openings (126) are sized to permit such mounting tabs to be inserted therethrough. In addition, hub interface portions (124) are configured to abut the radially exterior surface of hub (16). Cuff portions (122) are configured to extend over part of the exterior surfaces of fan blades (30) when fan blades (30) are mounted to hub (16). Accordingly, hub interface portions (124) and cuff portions (122) are configured to substantially cover gaps (which might otherwise be exposed) between the proximal ends of fan blades (30) and the radially exterior surface of hub (16).

Hub interface portion (124) also includes a leading edge member boss (128) and a trailing edge member boss (130). Bosses (128, 130) are substantially rigid in the present example, though bosses (128, 130) may have any other suitable properties. Indeed, bosses (128, 130) may be varied, substituted, or supplemented in any suitable fashion; or even be omitted. As shown in FIG. 10, leading edge member boss (128) is configured to extend distally in the interior of leading edge member (50). Leading edge member boss (128) is sized and configured to keep projections (54, 56) of leading edge member (50) separated. Leading edge member boss (128) may thus help maintain engagement between projections (54, 56) of leading edge member (50) and projections (40, 42) of spine member (32); thereby reinforcing the coupling of leading edge member (50) with spine member (32). Similarly, and as shown in FIG. 11, trailing edge member boss (130) is configured to extend proximally in the interior of trailing edge member (60). Trailing edge member boss (130) is sized and configured to keep projections (64, 66) of trailing edge member (60) separated. Trailing edge member boss (130) may thus help maintain engagement between projections (64, 66) of trailing edge member (60) and projections (44, 46) of spine member (32); thereby reinforcing the coupling of trailing edge member (60) with spine member (32).

It should be understood that, as with other components described herein, trim piece (120) is merely optional, and trim piece (120) may be varied, substituted, or supplemented in a variety of ways, if not be omitted altogether. For instance, in some versions, trim piece (120) is constructed or at least modified in accordance with the teachings of U.S. Pub. No. 2009/0081045, the disclosure of which is incorporated by reference herein. Still other suitable variations, substitutes, or supplements for a trim piece (120) will be apparent to those of ordinary skill in the art in view of the teachings herein.

To the extent that trim pieces (120) are used, it should be understood that components of fan blades (30) may be secured to each other in a variety of sequences relative to the securing of fan blades (30) and trim pieces (120) to hub (16). For instance, in some versions, each fan blade (30) is first fully assembled (e.g., leading edge members (50) and trailing edge members (60, 70, 80) are secured to spine members (32), etc.). Next, trim pieces (120) are slid over the mounting tabs of hub (16), and each fully assembled fan blade (30) is then secured to the mounting tabs of hub. In some other versions, trim pieces (120) are first slid over the mounting tabs of hub (16), and each spine member (32) is then secured to a corresponding mounting tab of hub (16). Next, leading edge members (50) and trailing edge members (60, 70, 80) are secured to spine members (32). In some versions of this technique, leading edge members (50) and trailing edge members (60, 70, 80) are initially secured to spine members (32) just distal to the distal edge of cuff portion (122); and then leading edge members (50) and trailing edge members (60, 70, 80) are slid proximally along the remaining length of their corresponding spine members (32) until bosses (128, 130) are effectively inserted in the interiors of leading edge members (50) and trailing edge members (70). Still other suitable assembly techniques will be apparent to those of ordinary skill in the art in view of the teachings herein.

In the present example, fan blade (30) has a leading edge (58) whose configuration is consistent along the length of fan blade (30). In particular, this is due to leading edge member (50) being formed as substantially straight extrusion having a uniform cross section along its length, with the length of leading edge member (50) being approximately equal to the length of central spine member (32). By contrast, the configuration of the trailing edge (68, 78, 88) is not consistent along the length of fan blade (30) in the present example. This is due to the presence of three differently configured trailing edge members (60, 70, 80) being positioned along the length of fan blade (30). It should be understood, however, that other versions of fan blade (30) may have a leading edge whose configuration is not consistent along the length of fan blade (30). By way of example only, an alternative version of leading edge member (50) may have a configuration that is inconsistent along the length of the alternative leading edge member. The leading edge of fan blade (30) may thus have a configuration that is inconsistent along the length of fan blade (30), even if just one alternative leading edge member is secured to a central spine member (32). Alternatively, more than one leading edge member may be secured to a central spine member (32) to provide a leading edge configuration that is inconsistent along the length of fan blade (30) (e.g., relatively broad chord leading edge member combined with relatively narrow chord leading edge member and transition leading edge member).

It should also be understood that other versions of fan blade (30) may have a trailing edge whose configuration is consistent along the length of fan blade (30). For instance, an alternative version of fan blade (30) may include just one trailing edge member (70 or 60) that has a length approximately equal to the length of central spine member (32). Such a longitudinally consistent configuration of a trailing edge may be provided regardless of whether the leading edge configuration is also longitudinally consistent. That is, some versions of fan blade (30) may have a longitudinally consistent trailing edge configuration with a longitudinally inconsistent leading edge configuration; while some other versions of fan blade (30) may have a longitudinally consistent trailing edge configuration with a longitudinally consistent leading edge configuration.

While fan blade (30) of the present example includes just three different types of trailing edges (68, 78, 88), it should be understood that fan blade (30) may alternatively include more than three or less than three different types of trailing edges. Such different numbers trailing edge types may be provided by a correspondingly different number of trailing edge members. Alternatively, a given trailing edge member may itself provide more than one type of trailing edge.

It should also be understood that modular airfoil parts may provide variation in other properties of fan blade (30). In other words, modular airfoil parts may change various properties of fan blade (30) in addition to or in lieu of changing the chord length of fan blade (30). For instance, modular airfoil parts, regardless of whether they are provided as different leading edge members and/or different trailing edge members, may change the shape, camber line, weight, opacity, and/or various other properties of fan blade (30). It will be understood by those of ordinary skill in the art that certain changes in the configuration of fan blade (30) may significantly change the aerodynamic properties of fan blade (30), which may in turn significantly change the performance characteristics and/or method of operation for fan (10). The modularity of components of fan blade (30) may thus facilitate tailoring of fans (10) based on the current needs of a particular installation site, simply by choosing from various fan blade (30) components and by assembling selected components with relative ease (e.g., rather than having to design and manufacture an entirely new fan blade (30) "from scratch," etc.). Numerous properties of fan blade (30) that may be varied, as well as numerous ways in which modular airfoil parts may be used to vary such properties, will be apparent to those of ordinary skill in the art in view of the teachings herein.

Figure 12:
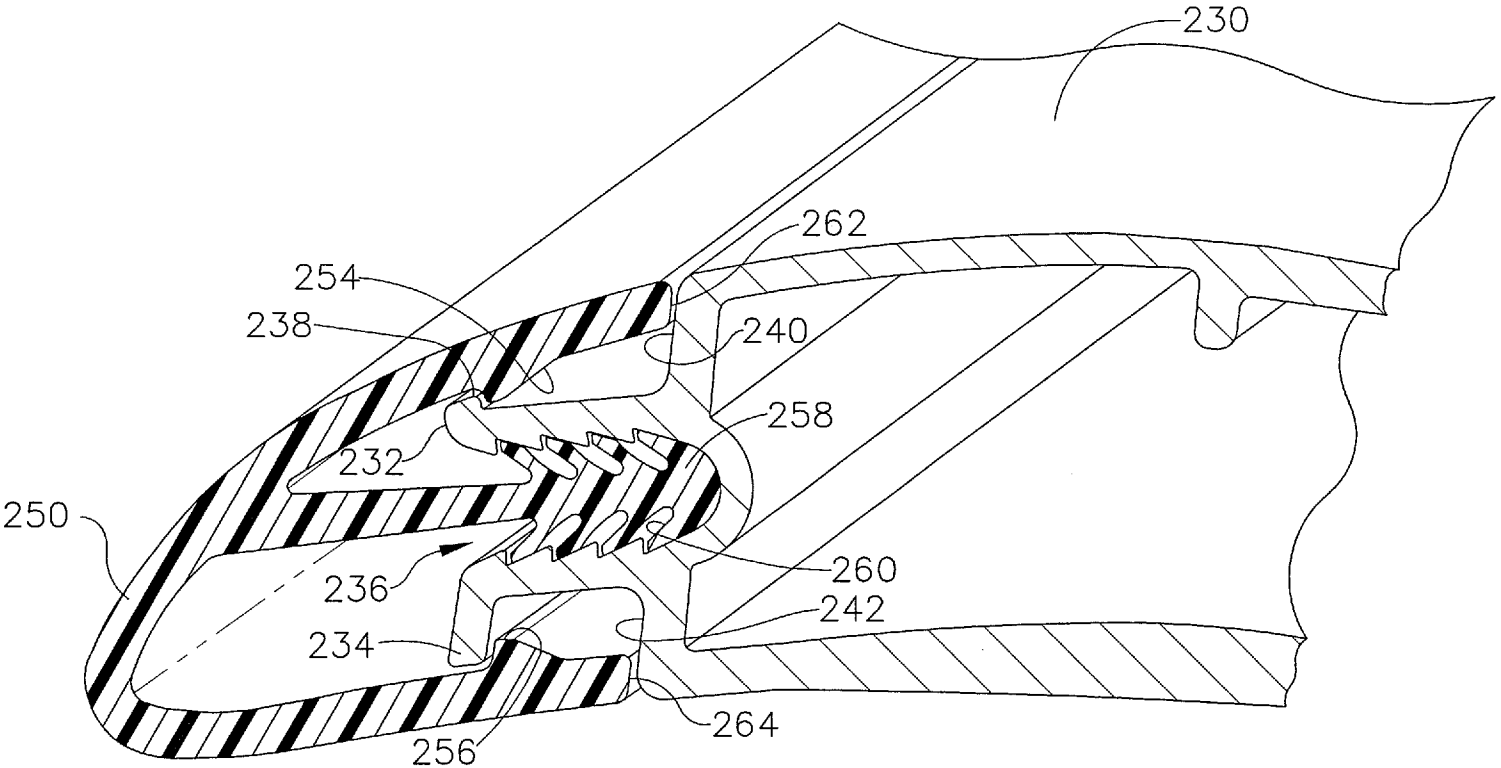
FIG. 12 depicts a cross-sectional view of an exemplary alternative leading edge component engaged with a spine component.

While the above disclosure describes various ways in which modular airfoil parts may be coupled together to assemble a complete fan blade (30), it should be understood that a variety of other types of structures, features, and techniques may be used to couple modular airfoil parts together. FIG. 12 illustrates a merely illustrative alternative way in which modular airfoil parts may be coupled together. In particular, FIG. 12 shows an exemplary alternative spine member (230) and an exemplary alternative leading edge member (250). Spine member (230) of this example includes an upper leading face (240) and a lower leading face (242). An upper projection (232) and a lower projection (234) extend from leading faces (240, 242). Projections (232, 234) define a ridged socket (236) that is configured to receive a barbed member (258) of leading edge member (250) as will be described in greater detail below. In particular, the interior of ridged socket (236) has a sawtooth profile in this example.

Leading edge member (250) of this example includes an upper interior ridge (254) and a lower interior ridge (256). Leading edge member (250) also includes an upper edge (262) and a lower edge (264). Barbed member (258) of leading edge member (250) includes a plurality of outwardly extending barbs (260). In particular, outwardly extending barbs (260) each have a fin-like shape and are resiliently biased to assume a generally outwardly extended configuration. Barbs (260) are configured to engage the interior longitudinally extending ridges formed in ridged socket (236) of spine member (230). In some versions, barbed member (258) extends along the entire length of leading edge member (250), which itself runs along the entire length of spine member (230). Leading edge member (250) may thus be formed as a single unitary piece using an extrusion technique (e.g., extruded plastic, etc.). Alternatively, any other suitable material(s), process(es), and/or number of pieces may be used to form leading edge member (250). In some versions, a plurality of discrete barbed members (258) extend from leading edge member (250) instead of a single barbed member (258) extending the full length of leading edge member (250).

In the present example, leading edge member (250) is coupled with spine member (230) by aligning leading edge member (250) with spine member (230) and moving leading edge member (250) in a direction substantially perpendicular to the longitudinal axis of spine member (230). During such motion, the upper portion of leading edge member (250) may deflect upwardly over upper projection (232) then resiliently "snap" downwardly after clearing upper projection (232). Similarly, the lower portion of leading edge member (250) may deflect downwardly over lower projection (234) then resiliently "snap" upwardly after clearing lower projection (234). In addition, barbs (260) may temporarily move inwardly toward the center axis defined by barbed member (258) during such motion of leading edge member (250) toward spine member (230); then resiliently extend outwardly to fully engage the interior of ridged socket (236). At this stage, engagement between upper interior ridge (254) of leading edge member (250) and ridge (238) of upper projection (232); engagement between barbed member (258) and ridged socket (236); and engagement between lower interior ridge (254) of leading edge member (250) and lower projection (234) may substantially secure leading edge member (250) to spine member (230). In addition, engagement between upper edge (262) of leading edge member (250) and upper leading face (240) of spine member (230); as well as engagement between lower edge (264) of leading edge member (250) and lower leading face (242) of spine member (230) may help stabilize the structural relationship between leading edge member (250) and spine member (230) by making such a connection more rigid.

The engagement of the barbs (260) with the interior ridges of socket (236) in the present example may be such that all barbs (260) engage all interior ridges substantially simultaneously (e.g., multiplying the retention strength of the assembly at a single specified depth of engagement); or the engagement with the interior ridges may be such that each barb (260) engages at a slightly different point of insertion (e.g., thus providing a number of possible depths of engagement to compensate for possible dimensional variations in manufacturing). Alternatively, barbs (260) may engage with the interior ridges of socket (236) in a variety of other ways.

While the above example describes assembly of leading edge member (250) and spine member (230) by moving leading edge member (250) relative to spine member (230) along an axis that is substantially perpendicular to the axis of spine member (230), it should be understood that leading edge member (250) and spine member (230) may be assembled in a variety of other ways. By way of example only, leading edge member (250) may alternatively be coupled with spine member (230) by moving leading edge member (250) along a direction that is substantially parallel to the axis of spine member (230). With respect to disassembly, some versions of leading edge member (250) may not permit leading edge member (250) to be removed from spine member (230) using a motion that is substantially perpendicular to the axis of spine member (230) (e.g., without substantially damaging barbed member (258), etc.). In some such versions, leading edge member (250) may be disassembled from spine member (230) by pushing or pulling leading edge member (250) in a direction that is substantially parallel to the axis of spine member (230). Still other suitable techniques for assembling and disassembling leading edge member (250) and spine member (230) will be apparent to those of ordinary skill in the art in view of the teachings herein.

While the example depicted in FIG. 12 just depicts a leading edge member (250) and spine member (230), it should be understood that various types of trailing edge members could be coupled with spine member (230). Such trailing edge members may couple with spine member (230) in a manner similar to that described above with respect to leading edge member (250). Alternatively, such trailing edge members may couple with spine member (230) in any other suitable fashion. As yet another merely illustrative alternative, spine member (230) may already have a trailing edge portion that is unitarily preformed with the rest of spine member (230). It should also be understood that spine member (230) may be coupled with hub (16) in a manner similar to that described above with respect to spine member (32); and that trim pieces (120) and winglets (100) may also be used with the version shown in FIG. 12.

While several exemplary structures have been described herein for providing engagement between components of a fan blade, it should be understood that a variety of other structures, features, components, and configurations may be used to provide engagement between components of a fan blade. Suitable alternatives will be apparent to those of ordinary skill in the art in view of the teachings herein. Furthermore, some components of a fan blade may engage in ways that are different from ways in which other components of a fan blade engage. By way of example only, a one or more leading edge members may engage with a central spine member in accordance with the version illustrated in FIG. 12; while one or more trailing edge members may engage with a middle component in accordance with the version illustrated in FIGS. 1-11. Still other suitable ways in which modular airfoil components may engage each other will be apparent to those of ordinary skill in the art in view of the teachings herein.

It should also be understood that alternative versions of fan blade (30) may only provide modularity in the leading edge or trailing edge. For instance, some alternative versions of fan blade (30) may have a leading edge that is unitarily formed with spine member (32) (e.g., spine member (32) extruded or molded with unitary leading edge). In some such versions, the alternative fan blade may still include a trailing edge engagement channel (36) yet lack a leading edge engagement channel (34). Alternatively, some alternative versions of fan blade (30) may have a trailing edge that is unitarily formed with spine member (32) (e.g., spine member (32) extruded or molded with unitary trailing edge). In some such versions, the alternative fan blade may still include a leading edge engagement channel (34) yet lack a trailing edge engagement channel (36).

In some versions, fan blades (30) may be provided as a kit with instructions. For instance, such a kit may include at least one spine member (32), one or more leading edge members (50), and one or more trailing edge members (60, 70, 80). In particular, and by way of example only, such a kit may include several different types of leading edge members (50) and/or several different types of trailing edge members (60, 70, 80), in addition to including at least one spine member (32). Such a kit may permit an assembler to choose from the various types of leading edge members (50) and/or various types of trailing edge members (60, 70, 80) to assemble a fan blade (30) having a desired configuration with relative ease. In other words, and regardless of whether a kit is involved, the modularity of leading edge members (50) and trailing edge members (60, 70, 80) may permit relatively easy customization and maintenance/repairs for fan blades (30); particularly since leading edge members (50) and trailing edge members (60, 70, 80) may come in various configurations and may be replaced with relative ease in some versions of fan blades (30).

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometries, materials, dimensions, ratios, steps, and the like discussed above are illustrative and are not required. Accordingly, the scope of the present invention should be considered in terms of claims that may be presented, and is understood not to be limited to the details of structure and operation shown and described in the specification and drawings.

We claim:

1. A fan blade, comprising:

(a) a first fan blade portion, wherein the first fan blade portion comprises (i) a first end, wherein the first end is configured to be coupled with a fan hub, (ii) a second end, wherein the first fan blade portion has a length extending between the first end of the first fan blade portion and the second end of the first fan blade portion, (iii) a trailing edge, and (iv) a leading edge engagement portion; and (b) a second fan blade portion secured to the first fan blade portion, wherein the second fan blade portion comprises:

(i) a first end, (ii) a second end, wherein the second fan blade portion has a length extending between the first end of the second fan blade portion and the second end of the second fan blade portion, (iii) a leading edge, and (iv) an engagement portion engaged with the leading edge engagement portion of the first fan blade portion, wherein the engagement portion comprises a first projection having a first ramped surface and a second projection having a second ramped surface, wherein the first projection and the second projection fit within the leading edge engagement portion;

wherein the first fan blade portion and the second fan blade portion together define an airfoil shape at one or more cross sections of the fan blade, wherein the trailing edge of the first fan blade portion defines a trailing edge of the airfoil shape, wherein the leading edge of the second fan blade portion defines a leading edge of the airfoil shape; and wherein the leading edge engagement portion of the first blade portion comprises a first projection, wherein the first projection projects transversely relative to the length of the first blade portion.

2. The fan blade of claim 1, wherein at least part of the first fan blade portion comprises aluminum.

3. The fan blade of claim 2, wherein at least part of the first fan blade portion comprises extruded aluminum.

4. The fan blade of claim 2, wherein the second fan blade portion comprises plastic.

5. The fan blade of claim 1, wherein the leading edge engagement portion of the first blade portion further comprises a second projection, wherein the second projection projects transversely relative to the length of the first blade portion.

6. The fan blade of claim 5, wherein the first blade portion further comprises an upper portion and a lower portion, wherein the first projection projects from the upper portion, wherein the second projection projects from the lower portion, such that the first projection and the second projection are spaced apart by a vertical height.

7. The fan blade of claim 5, wherein the first projection of the second blade portion is engaged with the first projection of the first blade portion, wherein the second projection of the second blade portion is engaged with the second projection of the first blade portion.

8. The fan blade of claim 1, wherein the first fan blade portion has a substantially uniform cross section along the length of the first fan blade portion.

9. The fan blade of claim 1, wherein the second fan blade portion has a substantially uniform cross section along the length of the second fan blade portion.

10. The fan blade of claim 1, wherein the length of the second fan blade portion extends along the length of the first fan blade portion.

11. The fan blade of claim 10, wherein the length of the second fan blade portion is equal to at least half of the length of the first fan blade portion.

12. The fan blade of claim 1, wherein the first fan blade portion further comprises a spine member and a first trailing edge member, wherein the spine member defines the first end of the first fan blade portion, the second end of the first fan blade portion, and comprises the leading edge engagement portion, wherein the spine member further comprises a trailing edge engagement portion, wherein the first trailing edge member defines the trailing edge along at least a first part of the length of the first fan blade portion and comprises an engagement portion engaged with the trailing edge engagement portion of the first fan blade portion.

13. The fan blade of claim 12, wherein the second fan blade portion and the first trailing edge member are each removably coupled with the spine member.

14. The fan blade of claim 12, further comprising a second trailing edge member, wherein the second trailing edge member further defines the trailing edge along a second part of the length of the first fan blade portion and comprises an engagement portion engaged with the trailing edge engagement portion of the first fan blade portion, wherein the first trailing edge member and the second trailing edge member are shaped differently relative to each other.

15. The fan blade of claim 14, further comprising a third trailing edge member, wherein the third trailing edge member further defines the trailing edge along a third part of the length of the first fan blade portion and comprises an engagement portion engaged with the trailing edge engagement portion of the first fan blade portion, wherein the third trailing edge member is positioned longitudinally between the first trailing edge member and the second trailing edge member.

16. The fan blade of claim 15, wherein the third trailing edge member provides a substantially smooth transition from the first trailing edge member to the second trailing edge member.

17. The fan blade of claim 1, further comprising a winglet secured to the first end of the fan blade.

18. A fan system, comprising:

(a) a motor;

(b) a hub coupled with the motor, wherein the motor is operable to rotate the hub; and (c) a plurality of fan blades coupled with the hub, wherein each fan blade of the plurality of fan blades comprises:

(i) a spine member coupled with the hub, wherein the spine member has a length extending radially outwardly relative to the hub, wherein the spine member comprises a first projection having a protrusion and a second projection having a protrusion, and (ii) a modular edge member coupled with the spine member, wherein the modular edge member extends along at least part of the length of the spine member, wherein the modular edge member defines a leading edge of the fan blade or a trailing edge of the fan blade, wherein the modular edge member comprises a third projection having a protrusion and a fourth projection having a protrusion, wherein the protrusions of the first and second projections correspond with the protrusions of the third and fourth projections to couple the modular edge member with the spine member.

19. A fan blade, comprising:

(a) a first fan blade portion, wherein the first fan blade portion comprises (i) a first end, wherein the first end is configured to be coupled with a fan hub, (ii) a second end, wherein the first fan blade portion has a length extending between the first end of the first fan blade portion and the second end of the first fan blade portion, (iii) a leading edge, and (iv) a trailing edge engagement portion, wherein the trailing edge engagement portion comprises a first protrusion having a ramped surface; and (b) a second fan blade portion secured to the first fan blade portion, wherein the second fan blade portion comprises:

(i) a first end, (ii) a second end, wherein the second fan blade portion has a length extending between the first end of the second fan blade portion and the second end of the second fan blade portion, (iii) a trailing edge, and (iv) an engagement portion engaged with the trailing edge engagement portion of the first fan blade portion, wherein the engagement portion comprises a second protrusion having a ramped surface that corresponds to the ramped surface of the first protrusion, wherein the ramped surfaces of the first and second protrusions engage each other when the trailing edge engagement portion is engaged with the engagement portion;

wherein the first fan blade portion and the second fan blade portion together define an airfoil shape, wherein the leading edge of the first fan blade portion defines a leading edge of the airfoil shape, wherein the trailing edge of the second fan blade portion defines a trailing edge of the airfoil shape.

20. The fan blade of claim 19, wherein the first fan blade portion further comprises a spine member and a leading edge member, wherein the spine member defines the first end of the first fan blade portion, the second end of the first fan blade portion, and comprises the trailing edge engagement portion, wherein the spine member further comprises a leading edge engagement portion, wherein the leading edge member defines the leading edge along at least a first part of the length of the first fan blade portion and comprises an engagement portion engaged with the leading edge engagement portion of the first fan blade portion.

21. A fan blade, comprising:

(a) a first fan blade portion, wherein the first fan blade portion comprises (i) a first end, wherein the first end is configured to be coupled with a fan hub, (ii) a second end, wherein the first fan blade portion has a length extending between the first end of the first fan blade portion and the second end of the first fan blade portion, (iii) a trailing edge, and (iv) a leading edge engagement portion; and (b) a second fan blade portion secured to the first fan blade portion, wherein the second fan blade portion comprises:

(i) a first end, (ii) a second end, wherein the second fan blade portion has a length extending between the first end of the second fan blade portion and the second end of the second fan blade portion, (iii) a leading edge, and (iv) an engagement portion engaged with the leading edge engagement portion of the first fan blade portion, wherein the engagement portion comprises a first projection having a first ramped surface and a second projection having a second ramped surface, wherein the first projection and the second projection fit within the leading edge engagement portion;

wherein the first fan blade portion and the second fan blade portion together define an airfoil shape at one or more cross sections of the fan blade, wherein the trailing edge of the first fan blade portion defines a trailing edge of the airfoil shape, wherein the leading edge of the second fan blade portion defines a leading edge of the airfoil shape;

wherein the first fan blade portion further comprises a spine member and a first trailing edge member, wherein the spine member defines the first end of the first fan blade portion, the second end of the first fan blade portion, and comprises the leading edge engagement portion, wherein the spine member further comprises a trailing edge engagement portion, wherein the first trailing edge member defines the trailing edge along at least a first part of the length of the first fan blade portion and comprises an engagement portion engaged with the trailing edge engagement portion of the first fan blade portion;

wherein the second fan blade portion and the first trailing edge member are each removably coupled with the spine member; and further comprising a second trailing edge member, wherein the second trailing edge member further defines the trailing edge along a second part of the length of the first fan blade portion and comprises an engagement portion engaged with the trailing edge engagement portion of the first fan blade portion, wherein the first trailing edge member and the second trailing edge member are shaped differently relative to each other.

* * * * *